US008428490B2

(12) United States Patent
Kawai et al.

(10) Patent No.: US 8,428,490 B2
(45) Date of Patent: Apr. 23, 2013

(54) COLOR ELECTROPHOTOGRAPHIC IMAGE FORMING APPARATUS

(75) Inventors: Toshiharu Kawai, Mishima (JP); Yoshihiro Ito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 388 days.

(21) Appl. No.: 12/711,516

(22) Filed: Feb. 24, 2010

(65) Prior Publication Data

US 2010/0221039 A1 Sep. 2, 2010

(30) Foreign Application Priority Data

Mar. 2, 2009 (JP) ..... 2009-048100

(51) Int. Cl.
*G03G 21/18* (2006.01)

(52) U.S. Cl.
USPC ..... 399/113; 399/121; 399/262

(58) Field of Classification Search ..... 399/113, 399/121, 262
See application file for complete search history.

(56) References Cited

U.S. PATENT DOCUMENTS

| | | | |
|---|---|---|---|
| 5,428,426 | A | 6/1995 | Inomata et al. |
| 5,903,803 | A | 5/1999 | Kawai et al. |
| 5,937,239 | A | 8/1999 | Watanabe et al. |
| 6,055,406 | A | 4/2000 | Kawai et al. |
| 6,115,567 | A | 9/2000 | Kawai et al. |
| 6,128,454 | A | 10/2000 | Kawai et al. |
| 6,144,398 | A | 11/2000 | Yokoyama et al. |
| 6,163,665 | A | 12/2000 | Watanabe et al. |
| 6,175,706 | B1 | 1/2001 | Watanabe et al. |
| 6,226,478 | B1 | 5/2001 | Watanabe et al. |
| 6,240,266 | B1 | 5/2001 | Watanabe et al. |
| 6,336,018 | B1 | 1/2002 | Kawai et al. |
| 6,349,188 | B1 | 2/2002 | Kawai et al. |
| 6,381,430 | B1 | 4/2002 | Yokomori et al. |
| 6,463,232 | B1 | 10/2002 | Kawai et al. |
| 6,480,687 | B1 | 11/2002 | Kawai et al. |
| 6,496,667 | B2 | 12/2002 | Shiratori et al. |
| 6,501,926 | B1 | 12/2002 | Watanabe et al. |
| 6,501,927 | B1 | 12/2002 | Watanabe et al. |
| 6,560,422 | B2 | 5/2003 | Kanno et al. |
| 6,654,567 | B2 | 11/2003 | Karakama et al. |
| 6,697,578 | B2 | 2/2004 | Watanabe et al. |

(Continued)

FOREIGN PATENT DOCUMENTS

JP 2006-330502 12/2006

OTHER PUBLICATIONS

Office Action in Japanese Patent Application No. 2009-048100, mailed Mar. 30, 2010 (with excerpt English translation).

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

A color electrophotographic image forming apparatus includes cartridge mounting portions for dismountably mounting cartridges and an intermediary transfer member onto which developed images formed on electrophotographic photosensitive drums are transferred. The apparatus also includes an image forming unit comprising the cartridge mounting portions and the intermediary transfer member. The unit is movable between a transfer position for transferring, onto a sheet, the developed images transferred onto the intermediary transfer member from the drums, a cartridge mounting and dismounting position for mounting and dismounting the cartridges relative to the cartridge mounting portions, and an intermediary transfer member mounting and dismounting position for mounting and dismounting the intermediary transfer member relative to a main assembly.

12 Claims, 30 Drawing Sheets

U.S. PATENT DOCUMENTS

| | | | | |
|---|---|---|---|---|
| 6,701,107 | B2 | 3/2004 | Karakama et al. | |
| 6,735,403 | B2 | 5/2004 | Kanno et al. | |
| 6,738,588 | B2 | 5/2004 | Yokomori et al. | |
| 6,782,213 | B2 | 8/2004 | Watanabe et al. | |
| 6,782,222 | B2 | 8/2004 | Ito et al. | |
| 6,832,056 | B2 | 12/2004 | Watanabe et al. | |
| 6,947,686 | B2 | 9/2005 | Kawai et al. | |
| 6,968,142 | B2 | 11/2005 | Arimitsu et al. | |
| 7,016,626 | B2 | 3/2006 | Yokomori et al. | |
| 7,027,754 | B2 | 4/2006 | Harada et al. | |
| 7,046,942 | B2 | 5/2006 | Arimitsu et al. | |
| 7,085,516 | B2 | 8/2006 | Kawai et al. | |
| 7,130,560 | B2 | 10/2006 | Kawai et al. | |
| 7,233,752 | B2 | 6/2007 | Harada et al. | |
| 7,257,353 | B2 | 8/2007 | Kawai et al. | |
| 7,310,489 | B2 | 12/2007 | Kawai | |
| 7,457,569 | B2 | 11/2008 | Kawai | |
| 7,555,249 | B2 | 6/2009 | Kawai | |
| 8,185,013 | B2 * | 5/2012 | Kikuchi et al. | 399/111 |
| 2003/0086732 | A1 * | 5/2003 | Abe et al. | 399/299 |
| 2005/0002689 | A1 * | 1/2005 | Jeong et al. | 399/111 |
| 2008/0170881 | A1 * | 7/2008 | Choi et al. | 399/113 |
| 2009/0245862 | A1 | 10/2009 | Kawai | |
| 2009/0290903 | A1 | 11/2009 | Horikawa et al. | |
| 2009/0290904 | A1 | 11/2009 | Kawai et al. | |
| 2010/0221037 | A1 * | 9/2010 | Miyazaki | 399/112 |
| 2010/0239308 | A1 * | 9/2010 | Kikuchi et al. | 399/110 |
| 2010/0239312 | A1 * | 9/2010 | Kikuchi et al. | 399/111 |
| 2010/0247140 | A1 * | 9/2010 | Kikuchi et al. | 399/111 |
| 2010/0247142 | A1 * | 9/2010 | Kikuchi et al. | 399/112 |
| 2011/0142488 | A1 * | 6/2011 | Yamashita | 399/110 |
| 2011/0142490 | A1 * | 6/2011 | Kikuchi et al. | 399/111 |
| 2011/0158681 | A1 * | 6/2011 | Kikuchi et al. | 399/111 |
| 2011/0305480 | A1 * | 12/2011 | Tanaami et al. | 399/112 |

* cited by examiner (a)

(b)

COLOR ELECTROPHOTOGRAPHIC IMAGE FORMING APPARATUS

FIELD OF THE INVENTION AND RELATED ART

The present invention relates to a color electrophotographic image forming apparatus for forming an image on a recording material, wherein a plurality of cartridges are dismountably mounted to a main assembly of the apparatus.

Here, the color electrophotographic image forming apparatus forms a color image on the recording material using an electrophotographic image forming process. The examples of the color electrophotographic image forming apparatus include a color electrophotographic copying machine, a color electrophotographic printer (color laser beam printer, color LED printer, for example), a color facsimile device, and a color word processor. The image is formed by the electrophotographic image forming apparatus on a recording material, and the recording material is paper, an OHP sheet, for example. The cartridge is a process cartridge, a developing cartridge or the like and contributes to an image forming process for forming the image on the recording material in the state that it is mounted to the main assembly of the electrophotographic image forming apparatus. Here, the process cartridge contains at least one of the charging means, developing means, cleaning means as process means, and the electrophotographic photosensitive drum as a unit integrally, and it is dismountably mountable to the main assembly. The process cartridge may contain the developing means as the process means and the electrophotographic photosensitive drum as a unit, and it is dismountably mounted to the main assembly of the electrophotographic image forming apparatus. The process cartridge may contain the charging means, the developing means, or the cleaning means as the process means and the electrophotographic photosensitive drum as a unit and it is dismountably mounted to the main assembly. The process cartridge which is provided integrally with the electrophotographic photosensitive drum and the developing means is called an integral-type process cartridge. The process cartridge which is provided integrally with the electrophotographic photosensitive drum and the process means other than the developing means is called a discrete type process cartridge. In this case, the developing means is provided in a developing unit unintegral with the process cartridge, and the discrete type process cartridge forms the image using the combination with such a developing unit. The process cartridge is mounted and demounted relative to the main assembly by a user. For this reason, the maintenance of the device is easy. The process means acts on the electrophotographic photosensitive drum. The developing cartridge is provided with a developing roller, and an electrostatic latent image formed on the electrophotographic photosensitive drum is developed by the developing roller. It contains a developer (toner) for the development, and is dismountably mounted to the main assembly. In the case of the developing cartridge, the electrophotographic photosensitive drum is mounted to the main assembly or a cartridge supporting member. Or, the electrophotographic photosensitive drum is provided in a so-called discrete type process cartridge. In this case, the process cartridge is not provided with the developing means. The developing cartridge is also mounted and demounted relative to the main assembly by the user. For this reason, the maintenance of the device is easy. Therefore, the cartridge in this invention includes the process cartridges of a so-called the integral type or a so-called discrete type. The cartridge includes the combination of the so-called process cartridge of the discrete type and the developing cartridge. In another example of the cartridge, the electrophotographic photosensitive drum is mounted fixedly to the main assembly or the cartridge supporting member and the detachably mountable developing cartridge acts on the electrophotographic photosensitive drum. As has been described hereinbefore, the electrophotographic image forming apparatus for forming the image on the recording material using the electrophotographic image forming process is known. In this electrophotographic image forming apparatus, the process cartridge type described above is known. In addition, the developing cartridge type which comprises only the developing unit unintegral with the photosensitive drum is known. In the present invention, the process cartridge type and the developing cartridge type are usable. The process cartridge and the developing cartridge are provided with a developer accommodating portion which contains the developer (toner) for developing the electrostatic latent image.

U.S. Pat. No. 5,428,426 discloses an image forming apparatus which can form the color image. In this image forming apparatus, an intermediary transfer member is rotated by a driving source of a main assembly side, and the photosensitive drum is rotationally driven through the intermediary transfer member. With this structure, in mounting the process cartridge into the main assembly, it will suffice only if the image bearing member is accurately positioned relative only to the intermediary transfer member. Therefore, the mounting and demounting and positioning relative to the main assembly of the process cartridge are easy.

SUMMARY OF THE INVENTION

The present invention further develops the conventional structure described above.

It is another aspect of the present invention to provide a color electrophotographic image forming apparatus, wherein the mounting and dismounting operativity at the time of mounting and demounting the cartridge and the intermediary transfer member relative to the main assembly is improved.

It is a further object of the present invention to provide a color electrophotographic image forming apparatus wherein the user's operations are simple, and the incorrect mounting at the time of the maintenance and so on can be prevented.

It is a further object of the present invention to provide a color electrophotographic image forming apparatus, wherein a unit with which an exchange frequency is low is made detachably mountable only at the time of necessity thereby to improve the usability, and a downsizing of the device is completed.

It is a further object of the present invention to provide a color electrophotographic image forming apparatus, wherein the mounting and dismounting operativity at the time of mounting and demounting the cartridge relative to the main assembly is improved.

It is a further object of the present invention to provide a color electrophotographic image forming apparatus can be provided wherein the user's operations are simple, and the incorrect mounting which may occur at the time of the maintenance and so on can be prevented. According to another aspect of the present invention a unit with which an exchange frequency is low is made detachably mountable only at the time of necessity thereby to improve the usability, and downsizing of the device is accomplished.

According to an aspect of the present invention, there is provided a color electrophotographic image forming apparatus for forming a color image on a recording material, said apparatus comprising a plurality of cartridge mounting portions for dismountably mounting cartridges; an intermediary transfer member onto which developed images formed on the plurality of electrophotographic photosensitive drums are transferred, said intermediary transfer member being provided opposed to said electrophotographic photosensitive drums; an image forming unit comprising said cartridge mounting portions and said intermediary transfer member, said image forming unit being movable between a transfer position for transferring, onto the recording material, the developed images transferred onto said intermediary transfer member from electrophotographic photosensitive drums, a cartridge mounting and dismounting position for mounting and dismounting said cartridges relative to said cartridge mounting portions, and an intermediary transfer member mounting and dismounting position for mounting and dismounting said intermediary transfer member relative to a main assembly of the apparatus of said color electrophotographic image forming apparatus; and a unit movement preventing means for permitting said image forming unit to move the intermediary transfer member mounting and dismounting position when no cartridge is mounted to any of said cartridge mounting portions, and for preventing said image forming unit from moving to the intermediary transfer member mounting and dismounting position when said cartridge is mounted to at least one of said cartridge mounting portions.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Figure 1:
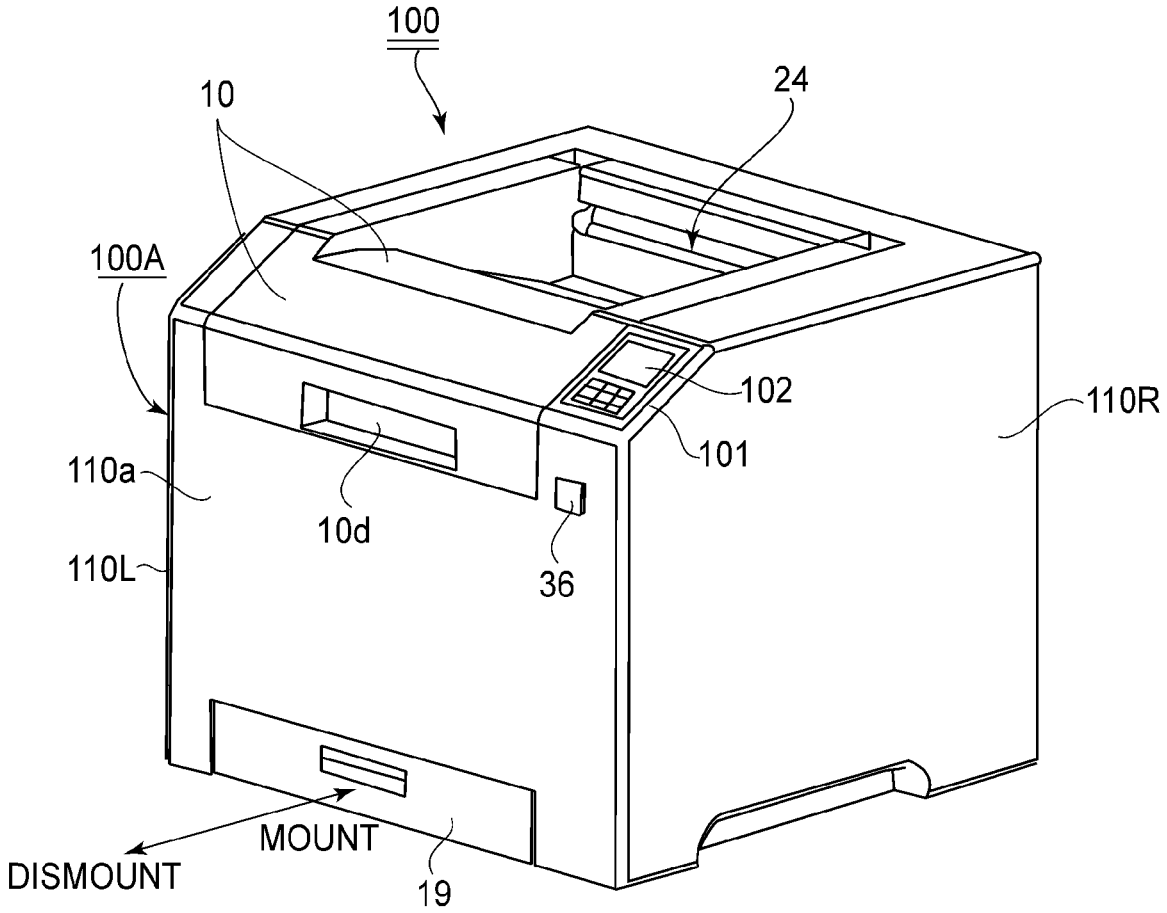
FIG. 1 is an outer appearance perspective view of the image forming apparatus of Embodiment 1.

An embodiment according to the present invention is described in hereinafter in detail on the basis of the drawing. The preferred embodiments of the present invention will be described in conjunction with the accompanying drawings. The dimensions, the materials, the configurations, the relative positions, and so on of the constituent parts which will be described hereinafter maybe properly changed by one skilled in the art depending on the structures and the various conditions of a device to which this invention is applied, and the scope of this invention is not limited to specific dimensions, materials, configurations, relative positions and so on of the embodiments which will be described below.

Embodiment 1

Figure 2A:
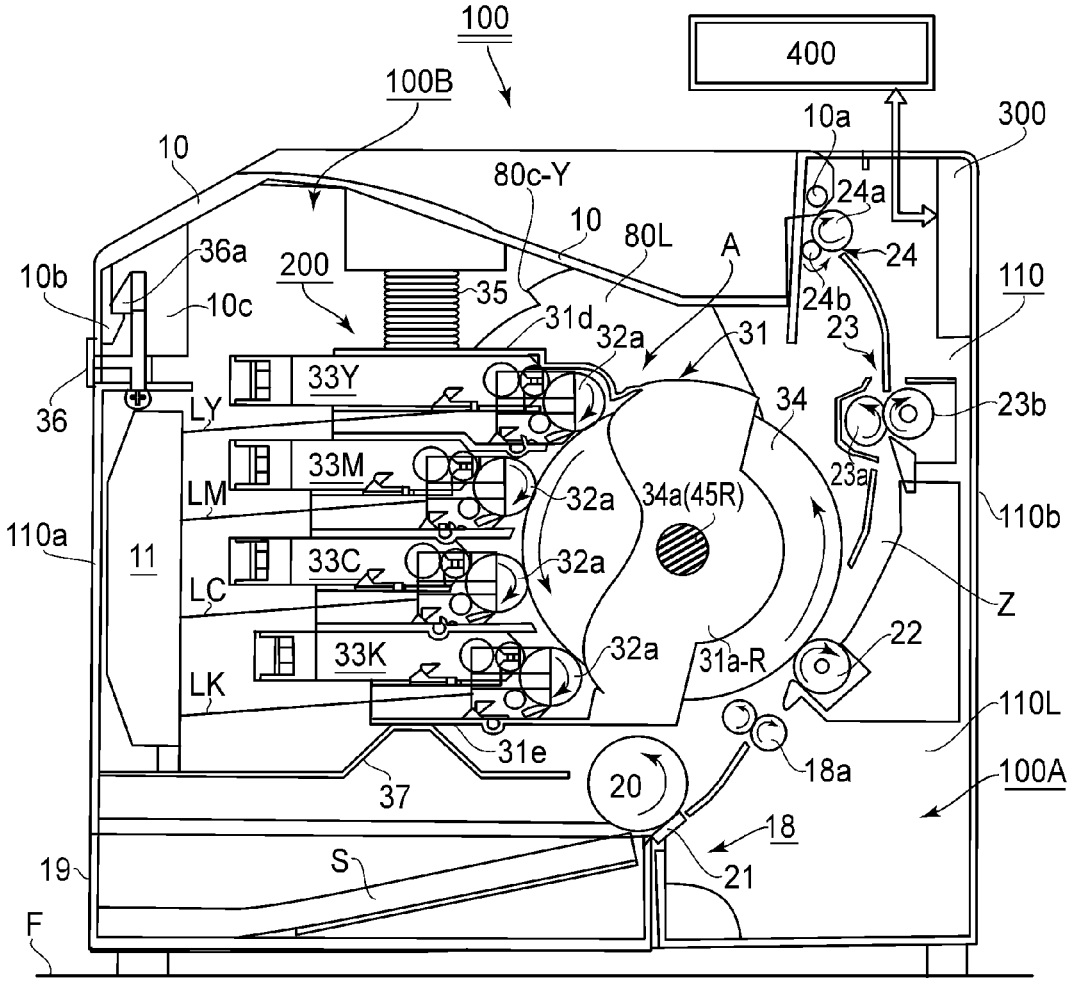
FIG. 2A is a schematic right side sectional view of the image forming apparatus of FIG. 1.

General Arrangement of an Example of Color Electrophotographic Image Forming Apparatus FIG. 2A is a right side longitudinal sectional view of the image forming apparatus 100. The image forming apparatus 100 is a laser printer of a full-color type which uses the electrophotographic process. The image forming apparatus 100 forms a full-color image on a recording material (sheet) S on the basis of the electrical image signal inputted to a control circuit portion 300 from an external host device 400 such as a personal computer, an image reader, a receiving part of a facsimile device. In the following descriptions of the image forming apparatus 100, a front side (front side) is a side, wherein a feeding cassette 19 which stacks a recording material S is drawn. A backside is the opposite side from it. An upper side is a direction of opening a maintenance cover 10. Front-rear directions are a direction to the front side from the backside of the image forming apparatus and the reverse direction thereof. The left and right are the left and right, as seen from the front side of the image forming apparatus. The left-right directions are a direction to the left from the right, and the reverse direction thereof. A main assembly 100A is a portion of the image forming apparatus other than a cartridge and an image forming unit 200.

Figure 2B:
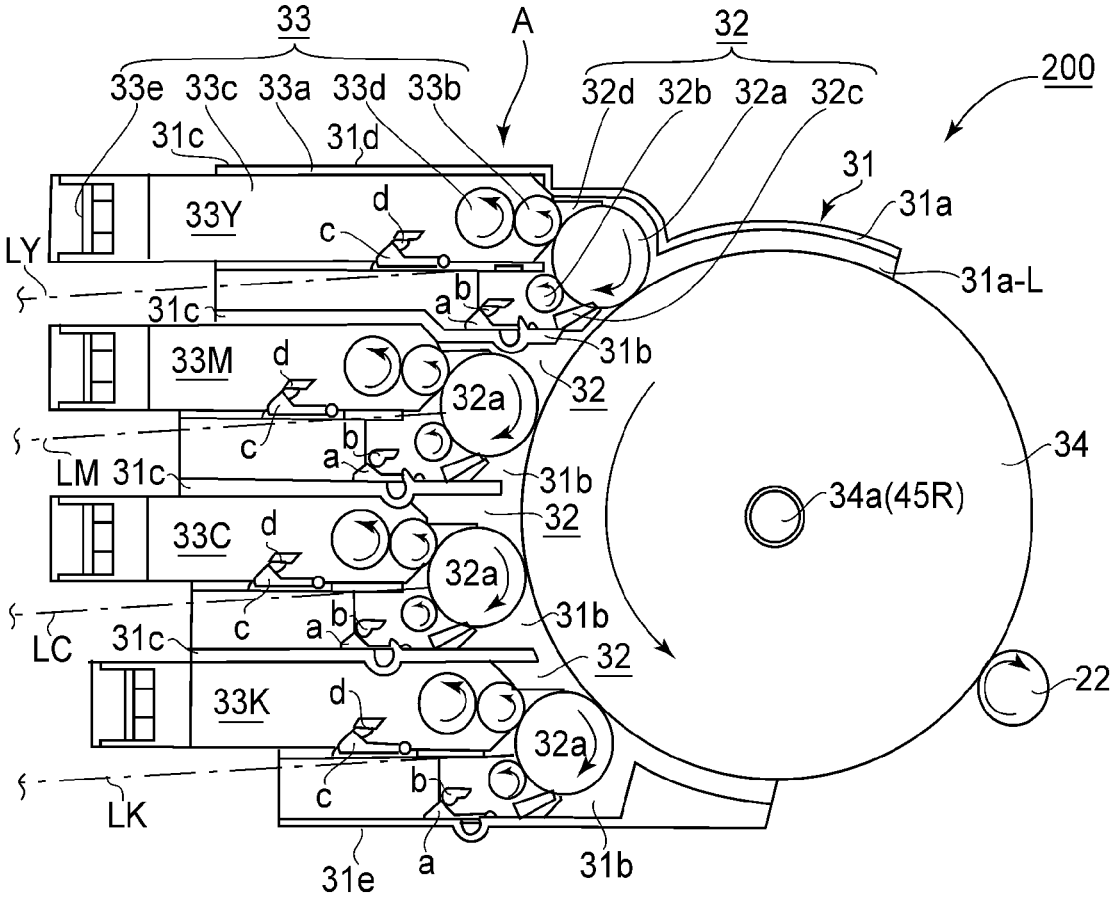
FIG. 2B is a partial enlarged view of the part FIG. 2A.

The image forming apparatus 100 is placed on a substantially horizontal installation surface F such as a mounting base, the desk or floor. The main assembly 100A includes an image forming unit 200. FIG. 2B is an enlarged view of a unit 200 portion of the image forming apparatus 100 shown in FIG. 2B. The unit 200 includes a cartridge mounting portion 31*c* for mounting a plurality of cartridges, that is first-fourth developing cartridge s 33 (33Y, 33M, 33C, 33K) in this embodiment dismountably and a single intermediary transfer member 34. In this embodiment, an electrophotographic photosensitive drum (drum) 32*a*, a charging roller (process means) 32*b*, and a cleaning blade (process means) 32*c* are mounted to the unit 200. In the image forming apparatus 100, a plurality of cartridges 33 are dismountably mounted to main assembly 100A (unit 200), and a color image is formed on recording material S. The unit 200 will be described in the detail hereinafter. In this embodiment, the cartridges 33 have the similar structures, other than the colors of contained developers (toner). However, they are not limited to this example. For example, a cartridge 33K which accommodates a black developer maybe larger in the capacity of a developer accommodating portion (a developing device 33*c*) than that of the cartridges 33 which accommodate the other color developers. In this embodiment and the embodiments which will be described hereinafter, although the cartridge is a developing cartridge, the present invention is not limited to this. For example, the drum 32*a*, the charging roller 32*b*, and the cleaning blade 32*c* mounted to the unit 200 in this embodiment maybe mounted to the developing cartridge 33. The cartridge which has such a structure is called process cartridge not developing cartridge. The process cartridge contains the drum 32*a* and a charging roller 32*b*, a developing roller 33*b*, and a cleaning blade 32*c* as the process means integrally as a cartridge, and it is dismountably mounted as a unit to the main assembly 100A. The unit 32 includes the drum 32*a*. The unit 32 includes the charging roller 32*b* and the cleaning blade 32*c* for removing the developer which remained on the surface of the drum 32*a*, as the process means which acts on the drum 32*a*. The drum 32*a*, the charging roller 32*b*, and the cleaning blade 32*c* are provided with a predetermined arrangement relation relative to a case 32*d* of the unit 32. The unit 32 is mounted to the unit 200.

The cartridge 33 includes a developing device case 33*a* and the developing roller 33*b* which is provided at the one end portion of this case 33*a* and which supplies the developer to the drum 32*a*. More particularly, the developing roller 33*b* develops an electrostatic latent image formed on the drum 32*a* into a developer image. The cartridge 33 includes the developing device 33*c* as the developer accommodating portion for accommodating the developer to be used for a development of the electrostatic latent image and a supplying roller 33*d* for supplying the developer from the developing device 33*c* to the developing roller 33*b*. The cartridge 33 is provided with a contact unit 33*e* for pressing the developing roller 33*b* with a predetermined pressure against the drum 32*a*. A first cartridge 33Y accommodates a yellow (Y) developer in the developing device 33*c* thereof, and forms a Y color developer image on the surface of the drum 32*a*. A second cartridge 33M accommodates a magenta (M) developer in the developing device 33*c* thereof, and forms an M color developer image on the surface of the drum 32*a*. A third cartridge 33C accommodates a cyan (C) developer in the developing device 33*c* thereof, and forms a C color developer image on the surface of the drum 32*a*. A fourth cartridge 33K accommodates a black (K) developer in the developing device 33*c* thereof, and forms a K color developer image on the surface of the drum 32*a*.

Figure 3:
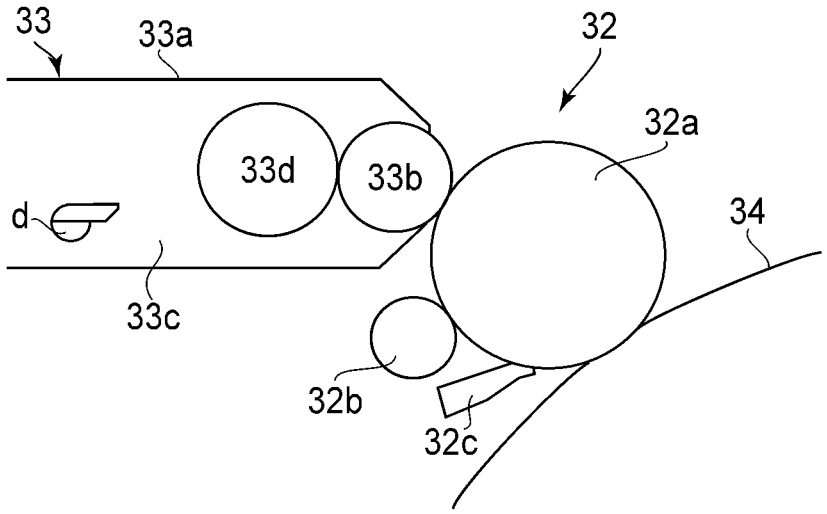
In FIG. 3, (a) is a schematic view of a contact type developing system, and (b) is a schematic view of the noncontact type developing system.
Figure 3:
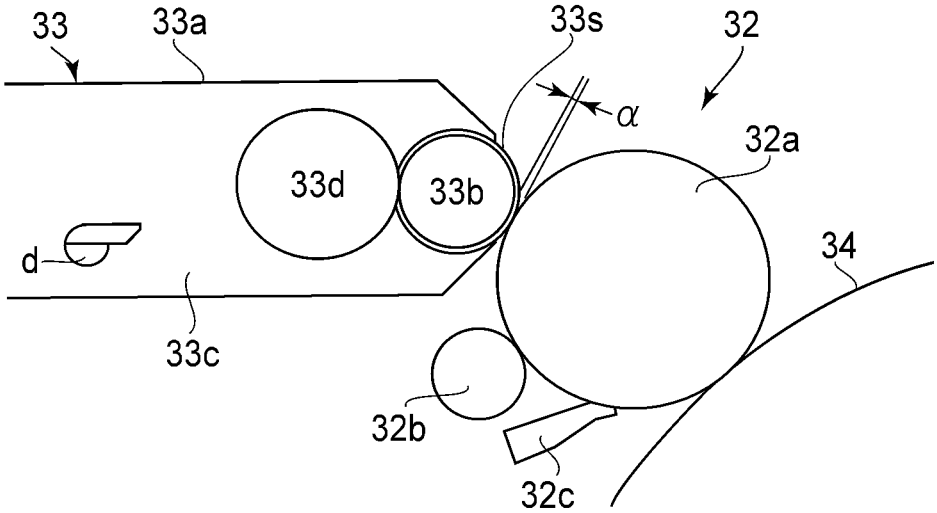

In this embodiment, the intermediary transfer member 34 is a cylindrical drum (intermediary transfer drum) horizontally extends along an axis of a rotation axis 34*a*. Each cartridge 33 is provided on a front side of the intermediary transfer member 34, and extends substantially parallel with the installation surface F of the main assembly 100A. They are provided adjacent to each other with respect to the substantially vertical direction. In the image forming apparatus of this embodiment, the first cartridge 33Y takes a top most stage position, and the second cartridge 33M is placed therebelow. The third cartridge 33C is further placed further below. The fourth cartridge 33K takes a bottom most stage position. The developing roller 33*b* of each cartridge 33 maybe in contact to the drum 32*a* as shown in (a) of FIG. 3 (contact type developing system). Or, as shown in (b) of FIG. 3, the developing roller 33*b* maybe spaced with a predetermined small gap (predetermined distance) $\alpha$ from the drum 32*a* (non-contact developing system). In (b) of FIG. 3, in order to maintain the predetermined gap $\alpha$, the spacers 33*s* provided on the left and right end portions of the developing roller 33*b* are contacted to the drum 32*a*. This embodiment employs a structure shown in (b) of FIG. 3. The front side of each cartridge 33 is provided with a laser scanner unit 11 as an image exposure device. The unit 11 is disposed between a front frame 110*a* of a main frame 110 which is a frame of the main assembly and the cartridges 33, in the main assembly 100A. The unit 11 includes a laser diode, a polygonal mirror, an F$\theta$ lens, a reflection mirror, and so on. The unit 11 outputs laser beams L (LY, LM, LC, LK) which are modulated correspondingly to the image information for the Y, M, C, K color inputted to the control circuit portion 300 from the external host device 400 to scan the drums 32*a* of the cartridges 33 for the corresponding colors (image exposure). In other words, the unit (image exposure device) 11 projects the light (laser beam) corresponding to the image information (including color information) to each drum 32*a*. By this, an electrostatic latent image corresponding to the image information is formed on each drum 32*a*.

Figure 10A:
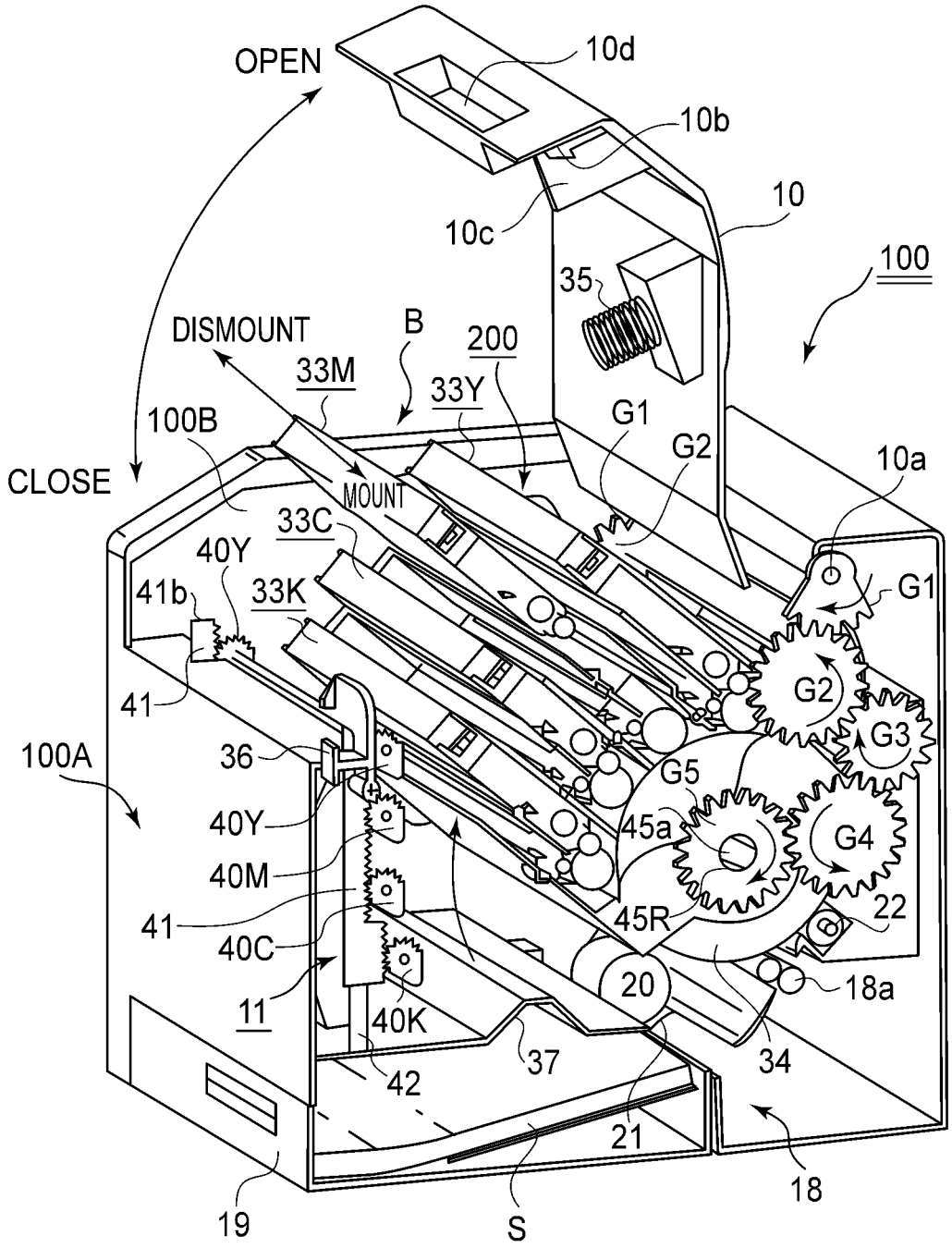
FIG. 10A illustrates the image forming apparatus (1), wherein the cover is opened to the open position, and the image forming unit is in the mounting and dismounting position.
Figure 10B:
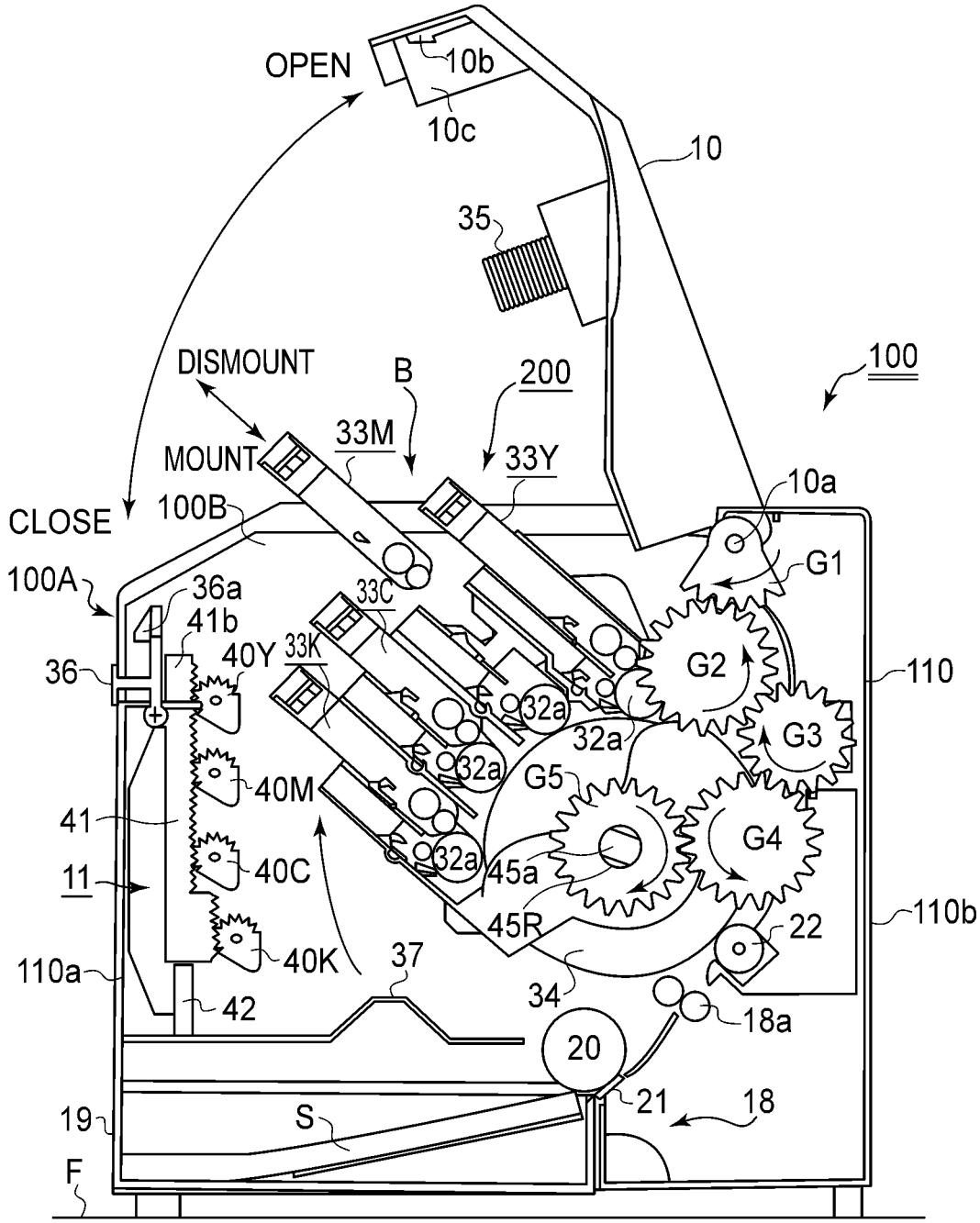
FIG. 10B illustrates the image forming apparatus (2) wherein the cover is opened to the open position, and the image forming unit is in the mounting and dismounting position.

A lower part of the unit 200 includes a feeding unit 18. The unit 18 includes a feeding cassette 19 for stacking recording material S, a feeding roller 20, a separation pad 21, and so on. The cassette 19 can go into and out of the front side of the main assembly 100A (front loading). In the main assembly 100A, between the intermediary transfer member 34 and a rear frame 110*b* of the main assembly 100A, there is provided a recording material feeding path Z extended from the feeding roller 20 to the upper rear portion in the main assembly 100A. A registration roller couple 18*a*, a secondary transfer roller 22, a fixing device 23, and a discharging roller pair 24 is provided along feeding path Z in this order upwardly. The fixing device 23 includes a fixing film unit 23*a* and a pressing roller 23*b*. The discharging roller pair 24 includes a discharging roller 24*a* and a discharging roller 24*b*. An upper surface of the main assembly 100A is provided with a maintenance cover 10 which functions as a discharging tray for receiving a recording material S on which the image has been formed. The cover 10 opens and closes an opening 100B provided in the upper surface of the main assembly 100A (opening and closing member). Through the opening 100B, as will be described hereinafter, the developing cartridge 33 is mounted and demounted relative to a cartridge mounting portion 31*c* of the unit 200 placed in the mounting and dismounting position B (FIG. 10A and FIG. 10B). In the state of FIG. 2A, a drive inputting portion (unshown) of the intermediary transfer member 34 of the unit 200 is coupled with a drive outputting portion (unshown) of a main assembly (100A). The drive inputting portions (unshown) of a photosensitive unit 32 and cartridge 33 couple with the drive outputting portions (unshown) provided in the main assembly 100A, respectively. The electrical contacts (unshown) of the photosensitive unit 32 and the cartridge 33 are electrically connected with an electric power supply system (unshown) of the main assembly (100A). The driving force transmission system and a bias voltage application system described above are not illustrated, for the sake of simplicity, since they maybe the same as those in the ordinary image forming apparatus.

The operation for forming a full-color image will be described. The drum 32*a* is rotated with a predetermined speed. (clockwise direction indicated by the arrow in (b) of FIG. 2). The charging roller 32*b* is rotated by the rotation of the drum 32*a*. The intermediary transfer member 34 is rotationally driven at the speed corresponding to the speed of the drum 32*a* in the counterclockwise direction (codirectional with the rotation of the drum 32*a*) of the arrow. In the cartridge 33, the developing roller 33*b* and the supplying roller 33*d* are rotationally driven at a predetermined controlled speed in the counterclockwise direction of the arrow. The scanner unit 11 is driven. In synchronism with this drive, a predetermined charging bias voltage is applied to the charging roller 32*b* at the predetermined controlled timing. By this, the surface of the drum 32*a* is uniformly charged by the charging roller 32*b* to the predetermined polarity and predetermined potential. A scanner unit 11 exposes the surface of each drum 32*a* scanningly to the laser beam L modulated in accordance with the Y, M, C, K image signals. By this, the electrostatic latent images corresponding to the associated color image signals are formed on the surfaces of the drum 32*a*. The electrostatic latent images formed on the surface of the drum 32*a* are developed into the developer images by the developing rollers 33*b*. The developing roller 33*b* is supplied with a predetermined developing bias voltage at the predetermined controlled timing. Through the above-described electrophotographic image forming process operation, a Y color developer image corresponding to a yellow component of the full-color image is formed on the drum 32*a* opposed by a cartridge 33Y. The developer image is transferred (primary transfer) onto the transfer member 34 in a primary transfer nip which is the contact portion between the drum 32*a* and the intermediary transfer member 34. An M color developer image corresponding to a magenta component of the full-color image is formed on the drum 32*a* opposed by a cartridge 33M. The developer image is transferred (primary transfer) onto the transfer member 34 in a primary transfer nip which is the contact portion between the drum 32*a* and the transfer member 34 superimposedly on the already transferred Y color developer image. A C color developer image corresponding to a cyan component of the full-color image is formed on the drum 32*a* opposed by a cartridge 33C. The developer image is transferred (primary transfer) onto the transfer member 34 in the primary transfer nip which is the contact portion between the drum 32*a* and the transfer member 34 superimposedly on the already transferred Y color +M color developer image. A K color developer image corresponding to a black component of the full-color image is formed on the drum 32*a* which the cartridge 33K opposed. The developer image is transferred (primary transfer) onto the transfer member 34 in the primary transfer nip which is the contact portion between the drum 32*a* and the transfer member 34 superimposedly on the already transferred Y color+M color+C color developer images.

In this way, a full-color developer image of the Y color +M color +C color +K color is synthetically formed on the transfer member 34. The order of the colors of the developer images sequentially superimposedly transferred onto the transfer member 34 is not limited to an above described order. The untransferred developer remaining on the drum surface after the primary transfer of the developer image relative to the transfer member 34 is removed by the cleaning blade 32*c*. On the other hand, the feeding roller 20 is driven at the predetermined controlled timing. In this manner, by a cooperation of the feeding roller 20 and the separation pad 21, the separation and feeding of the sheet-like recording materials S stacked in the feeding cassette 19 is carried out one by one. The recording material S is introduced into the secondary transfer nip which is the contact portion between the transfer member 34 and the secondary transfer roller 22, at the predetermined controlled timing by the registration roller couple 18*a*. The transfer roller 22 is supplied with the secondary transfer bias voltage of the predetermined potential having the polarity opposite to that of the charge polarity of the developer at the predetermined controlled timing. By this, while the recording material S is nipped and fed by the transfer nip, the developer image on the intermediary transfer member 34 on which it is superimposed is sequentially transferred (secondary transfer) onto the surface of recording material S. The recording material S passed through the secondary transfer nip is separated from the surface of the transfer member 34 and is introduced into the fixing device 23. It is heated and pressed by a fixing nip. By this, the color developer images are mixed and fixed on recording material S. The recording material S is discharged out of the fixing device 23, and is discharged on the maintenance cover 10 which functions as a discharging tray by discharging roller pair 24 as a full-color print. After the recording material S is separated from the transfer member 34, the toner remaining after the secondary transfer remaining on the surface of the transfer member 34 is electrostatically deposited on the surface of the drum 32*a* in the primary transfer nip of the drum 32*a* opposed by the first cartridge 33Y, for example, in the case of this embodiment. It is removed by the cleaning blade 32*c*.

Here, the transfer member 34 is a cylindrical rotatable member. On the transfer member 34, the different color developer images formed on the drums 32*a* are transferred superimposedly. The developer images transferred superimposedly is transferred all together onto the recording material S from the transfer member 34. By this, the color image is formed on the recording material S. In the case of a monochromatic image forming mode, the image formation is carried out only using the cartridge 33K for forming a black color image and the photosensitive unit 32 associated with this cartridge 33K. A black developer image formed on the drum 32*a* of the photosensitive unit 32 is transferred onto the transfer member 34. The transferred black developer image is transferred onto recording material S from the transfer member 34. A black image is formed on recording material S. A last image on recording material S is formed after the passage of recording material S through the fixing device 23. In this embodiment, the secondary transfer roller 22 is movable between a first position in which it contacts to the transfer member 34 and forms the secondary transfer nip and a second position spaced from the transfer member 34 by a shifting mechanism (unshown). At the time of an image forming operation of the image forming apparatus 100, the secondary transfer roller 22 is moved to the first position, and at the time of the non-image formation, it is moved to the second position. The secondary transfer roller 22 may normally be contacted with the intermediary transfer member 34.

(Image Forming Unit)

Figure 4:
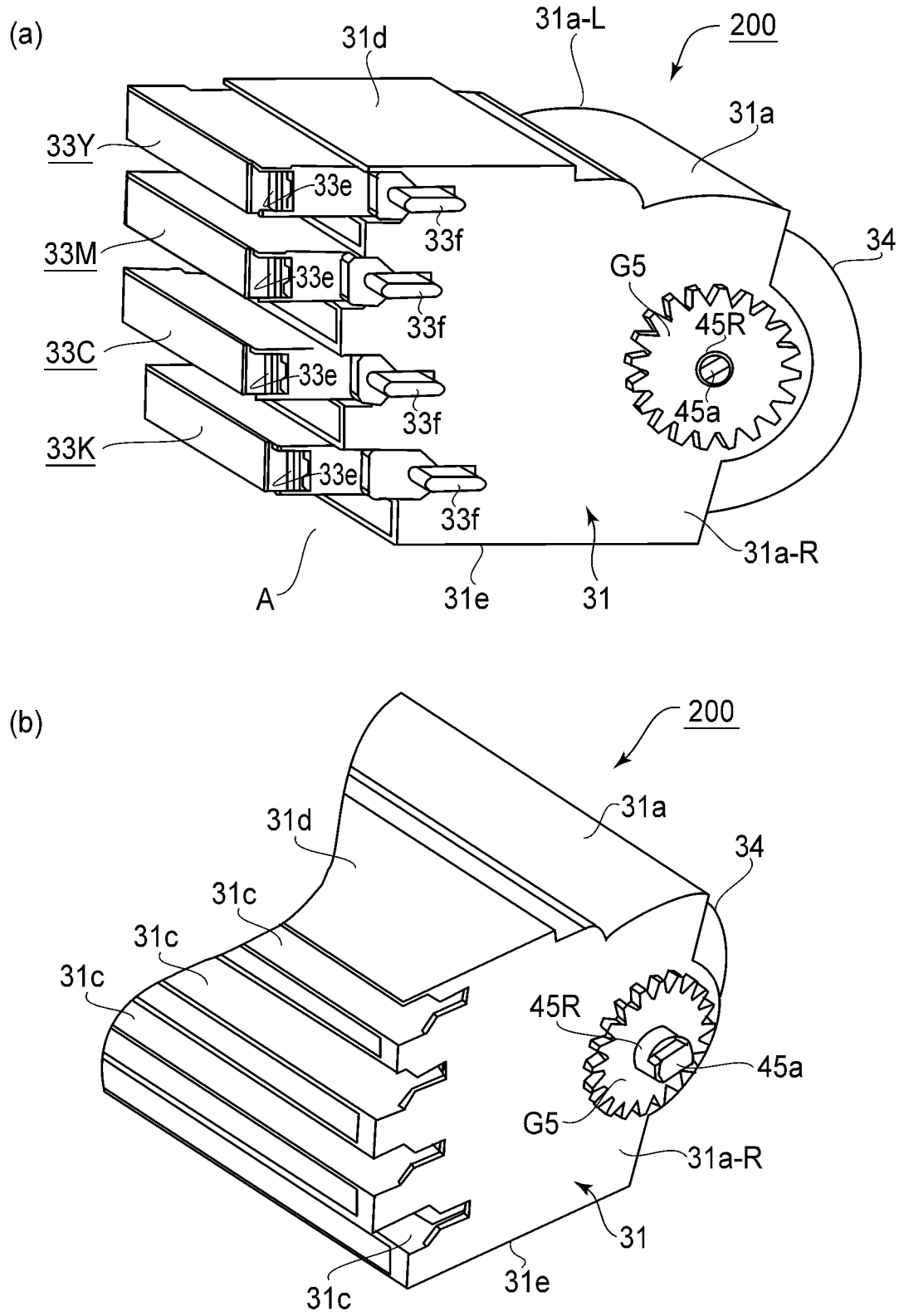
In FIG. 4, (a) is an outer appearance perspective view of an image forming unit, and (b) is a perspective view of a right half of the image forming unit in the state that a developing cartridge is dismounted.
Figure 5:
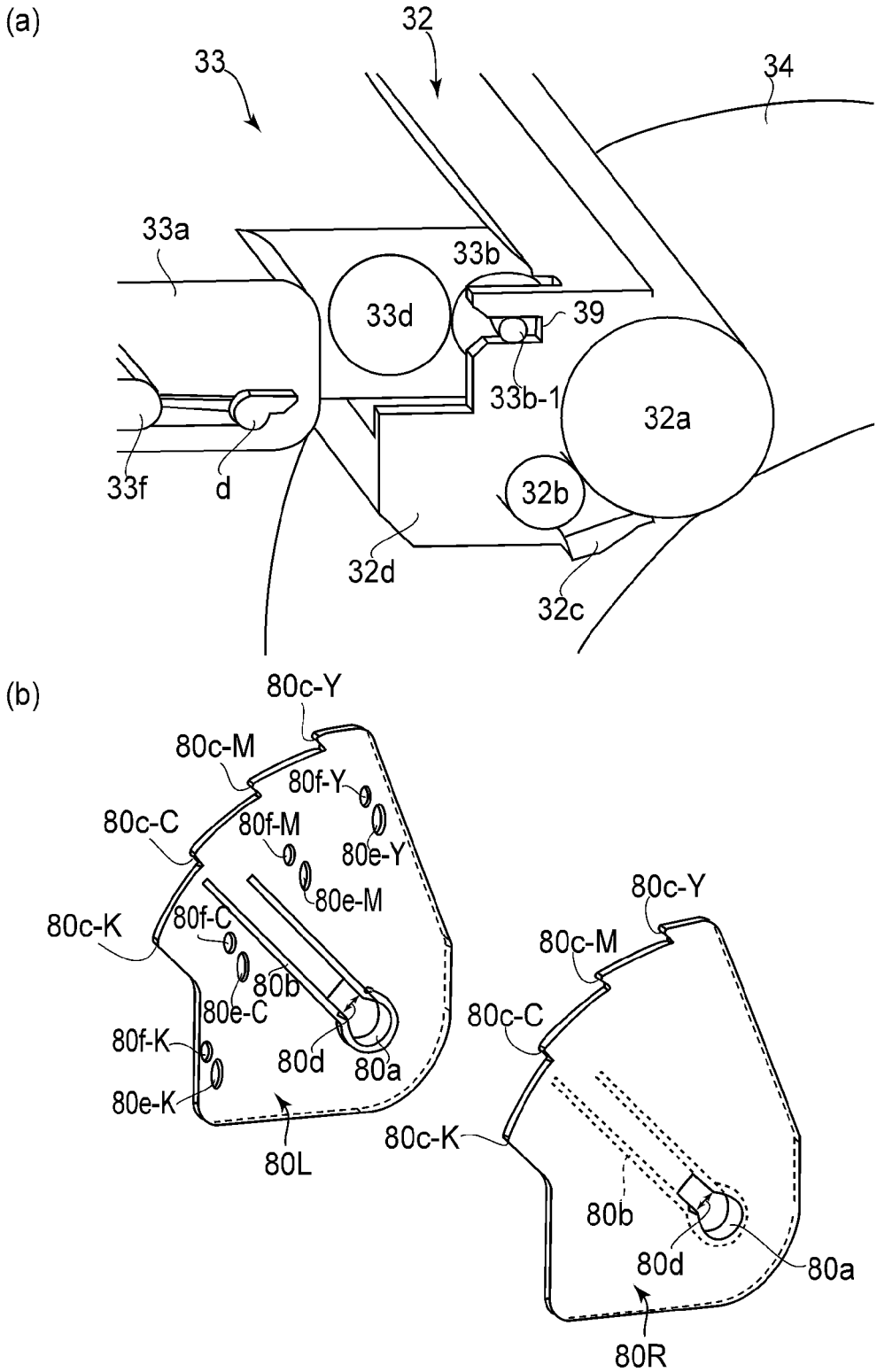
In FIG. 5, (a) is a perspective view of a positioning portion between the developing cartridge of the image forming unit and a photosensitive unit thereof, and (b) is a perspective view of left and right guiding plates.

Referring mainly to FIG. 2A, FIG. 2B, FIG. 4, and FIG. 5, the structure of the image forming unit 200 will be described. (a) of FIG. 4 is an outer appearance perspective view of the unit 200. (b) of FIG. 4 is a perspective view of the substantially right-half part of the unit 200 of the state that the cartridges 33 are dismounted. (a) of FIG. 5 is a perspective view of positioning portions for the developing cartridge 33 and the photosensitive unit 32 of the unit 200. The unit 200 is provided with a sub-frame 31 detachably mountable relative to the main frame 110 of the main assembly 100A. The sub-frame 31 is provided with an intermediary transfer frame 31*a* rotatably supporting the transfer member 34. The transfer member 34 is provided with a shaft (rotation axis) 34*a*, and the left-hand end portion and right-hand end portion thereof are supported rotatably between a left side plate 31*a*-L of the frame 31*a* and a right side plate 31*a*-R thereof. On the outer sides of the left side plate 31*a*-L and the right side plate 31*a*-R, a left shaft portion 45L (unshown) and a right shaft portion 45R co-axial with the center axis 34*a* of the transfer member 34 is fixed to the side plates 31*a*-L, 31*a*-R, respectively. The free end portions of the shaft portions 45L, 45R are reduced in the width into a key-shaped portion 45*a*. On the outer sides of the left side plate 31*a*-L and the right side plate 31*a*-R, a sub-frame gear G5 concentric with the shaft portions 45L, 45R is fixed to the shaft portions 45L, 45R or the side plates 31*a*-L, 31*a*-R.

The sub-frame 31 is provided with a photosensitive member supporting unit 31*b* (FIG. 2B) for supporting the photosensitive unit 32 of each cartridge 33. A photosensitive member case 32*d* of the photosensitive unit 32 is coupled to a unit 31*b*. The photosensitive unit 32 supported by the unit 31*b* is elastically urged toward the transfer member 34 by an engagement between an elastic material a provided on the unit (31*b*) and the projection material b provided on the photosensitive unit (32). By this, a photosensitive drum 32*a* is in contact, with a predetermined urging force, to the transfer member 34. The sub-frame 31 is provided with the cartridge mounting portions 31*c* for mounting the cartridge 33 dismountably. In this embodiment, the cartridge mounting portions 31*c* are the developing cartridge mounting portions (developing device coupling unit for tentatively holding developing cartridge 33) for mounting the cartridges 33 independently and dismountably. A mounting portion 31*c* has such a guiding configuration that the cartridge 33 is coupled to the photosensitive unit 32 mounted to the unit 31*b*. The developing device case 33*a* of the cartridge 33 is coupled to the mounting portion 31*c*. The cartridge 33 is provided with supporting means 33*f* for supporting ((a) it in FIG. 4), so that it may stably be held to the mounting portion 31*c* (mounting). The end of the rotation axis 33*b*-1 of the developing roller 33*b* is engaged with the positioning means 39 ((a) in FIG. 5) provided on the photosensitive member case 32*d* and supported by this, so that the position thereof is determined relative to the drum 32*a*. As shown in FIG. 2B, the cartridge 33 is provided with a projecting member d (locking claw (locking portion)). The mounting portion 31*c* (unit 200) is provided with an elastic material c (locking claw (locking portion)). The cartridge 33 mounted to the mounting portion 31*c* is tentatively held by the mounting portion 31*c* by the engagement between the projecting member d and the elastic material c. More particularly, by the elastic material c and the projecting member d locking with each other releasably, the cartridge 33 is dismountably mounted to the mounting portion 31*c* (unit 200). However, this embodiment is not limited to this example. For example, the claw (locking portion) provided on one side maybe elastically and releasably locked with the hole (locking portion) provided in another side.

As shown in (b) of FIG. 5, on the inside of a left-hand side frame 110L, and the inside of a right-hand side frame 110R of the main frame 110 of the main assembly 100A, a left-hand side guiding plate 80L and a right-hand side guiding plate 80R which are opposed to each other and which are symmetrical with each other are provided fixedly. The guiding plates 80L, 80R are provided with a positioning portion 80*a* rotatably supporting the left and right shafts 45L, 45R of the sub-frame 31 and a guide 80*b* for guiding the shaft portions 45L, 45R. The guiding plates 80L, 80R are provided with the four symmetrical projections 80*c* (80*c*-Y, 80*c*-M, 80*c*-C, 80*c*-K). The positioning portion 80*a* is provided with an entrance opening 80*d* opened with the width smaller than the diameter of the shaft portions 45L, 45R toward the opening 100B of the main assembly 100A. The widths of the key-shaped portions 45*a* of the shaft portions 45L, 45R are the same as or slightly smaller than the width of the entrance opening 80*d*. In the image forming apparatus 100 of this embodiment, the left-hand side frame (110L) is the driving side, and the right-hand side frame (110R) is the non-driving side. A left guiding plate 80L in the driving side is provided with a hole portion 80*e* (80*e*-Y, 80*e*-M, 80*e*-C, 80*e*-K) for the entering and leaving of a drive outputting portion for the photosensitive unit 32 mounted to the sub-frame 31. The left guiding plate 80L is provided with a hole portion 80*f* (80*f*-Y, 80*f*-M, 80*f*-C, 80*f*-K) for the entering and leaving of the drive outputting portion for each cartridge 33.

In the unit 200, the left and right shaft portions 45L, 45R are rotatably supported between the left and right guiding plates 80L, 80R in the main assembly 100A by the left and right positioning portions 80*a*, respectively. More particularly, the unit 200 is rotatable about the shaft portions 45L, 45R, i.e., a rotational center 34*a* of the transfer member 34, between the left and right guiding plates 80L, 80R in the main assembly 100A. By this, the unit 200 can take the transfer position A (FIG. 2A) for transferring the developer image which has been transferred onto the transfer member 34 from the drum 32*a* onto recording material S. The unit 200 can take the mounting and dismounting position B (FIG. 10B) for mounting and demounting the cartridge 33 relative to the mounting portion 31*c*. More particularly, the unit 200 is movable between the transfer position A and the mounting and dismounting position B. This will be described hereinafter.

A rear side of the cover (opening and closing member) 10 is rotatably coupled through a hinge shaft 10*a* to the main assembly 100A. The cover 10 is movable between the closed position for closing a top opening 100B of the main assembly 100A and the open position for opening the opening portion 100B. The cover 10 is an opening and closing member for opening and closing the opening 100B in the upper portion of the main assembly 100A about the hinge shaft 10*a*. Through the opening 100B, the cartridge 33 is mounted and demounted relative to the cartridge mounting portion 31*c* of the unit 200 (FIG. 10B) placed in mounting and dismounting position B. As shown in FIG. 1 and FIG. 2A, the cover 10 normally closes the opening portion 100B. The closed state of the cover 10 is maintained by the engagement (latch engagement) between a locking claw portion (main assembly side locking portion) 36*a* provided on a maintenance button (36) provided on a front side of the main assembly 100A and the locking claw portion (opening and closing member side locking portion) 10*b* provided on cover (10). In this embodiment, the locking claw portion 36*a* and the locking claw portion 10*b* is elastically locked releasably. However, this embodiment is not limited to this example. For example, the claw (locking portion) provided on one side maybe elastically and releasably locked with the hole (locking portion) provided in another side. The inner side of the cover 10 is provided with the urging spring (elastic material) 3. In the state that the cover 10 is closed, a spring 35 is compressed against an elastic force between the inner side of the cover 10 and an upper surface 31*d* of the sub-frame 31 of a unit 100. By a compressive reaction force (elastic force) of the spring 35, the frame 31 is urged counter-clockwisely in FIG. 2A about the axis of the shaft portion 45L, 45R so that a lower surface 31*e* of the frame 31 is pressed against a main stay 37 (main assembly side positioning portion) in the main assembly (100A) side. By this, the frame 31 is held in the positioned state. In other words, the unit 200 is maintained in the state in which it is positioned in the transfer position (operative position for the image formation) (FIG. 2A, FIG. 2B) A for transferring the developer image which has been transferred onto the intermediary transfer member 34 from the drum 32*a*, onto recording material S. That is the unit 200 is locked at image forming position A by the cooperation of the cover 10, the locking claw portion 10*b* of the cover, the spring 35, and the main stay 37 (FIG. 2A). Here, the cover 10, the locking claw portion 10*b* on the cover side, the spring 35, and main stay 37 constitute a locking member (first locking member). The locking member releases the lock of the unit 200 in the state that the cover 10 is moved from the closed position to the open position. According to this embodiment, the unit 200 can be positioned in the main assembly 100A with high precision. In addition, the releasing of the positioning is easy. The structure of the locking member is not limited to this example, but other proper structures can be employed.

Figure 6A:
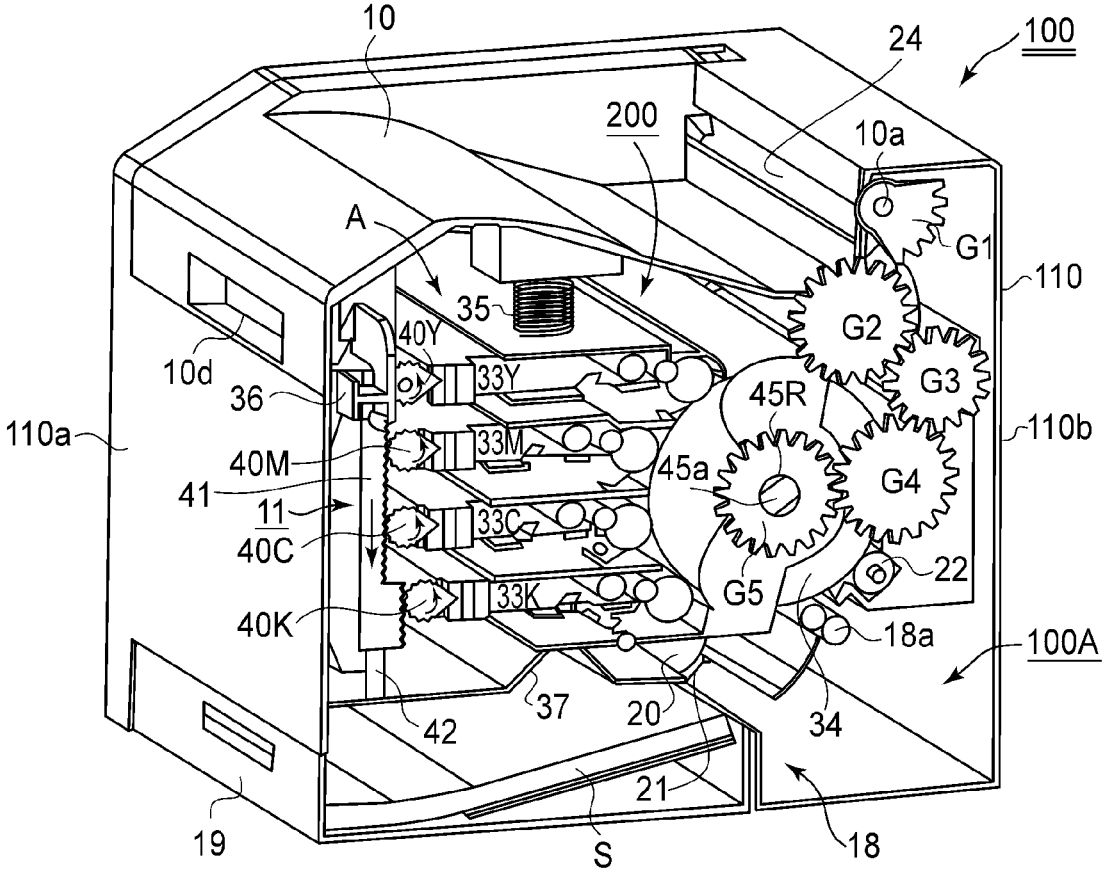
FIG. 6A illustrates the image forming apparatus (1), wherein a positioning member has been moved to a positioning place, and a developing cartridge 33 of each cartridge is positioned.
Figure 6B:
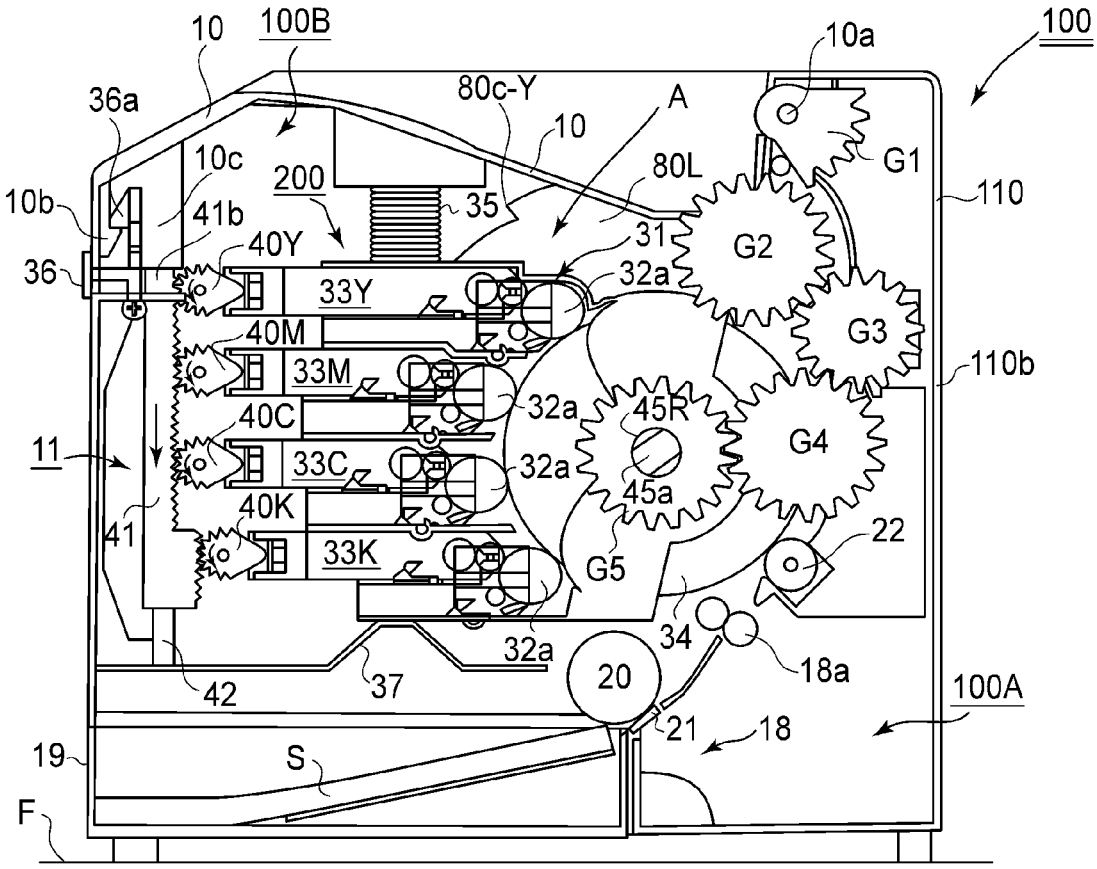
FIG. 6B illustrates the image forming apparatus (2), wherein the positioning member moves to the positioning place, and the developing cartridge 33 of each cartridge is positioned.
Figure 7:
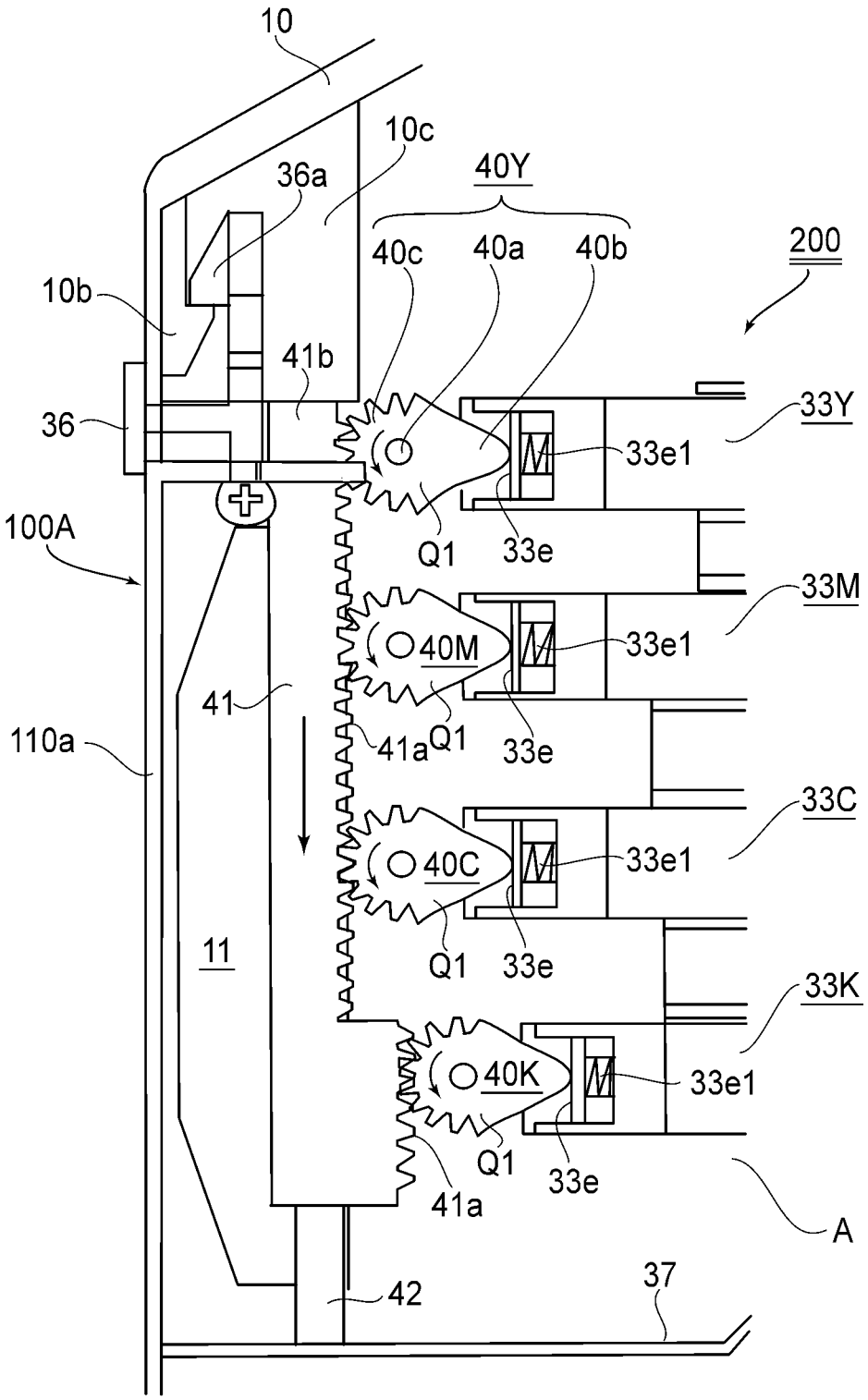
FIG. 7 shows a partial enlarged view of FIG. 6B.
Figure 8A:
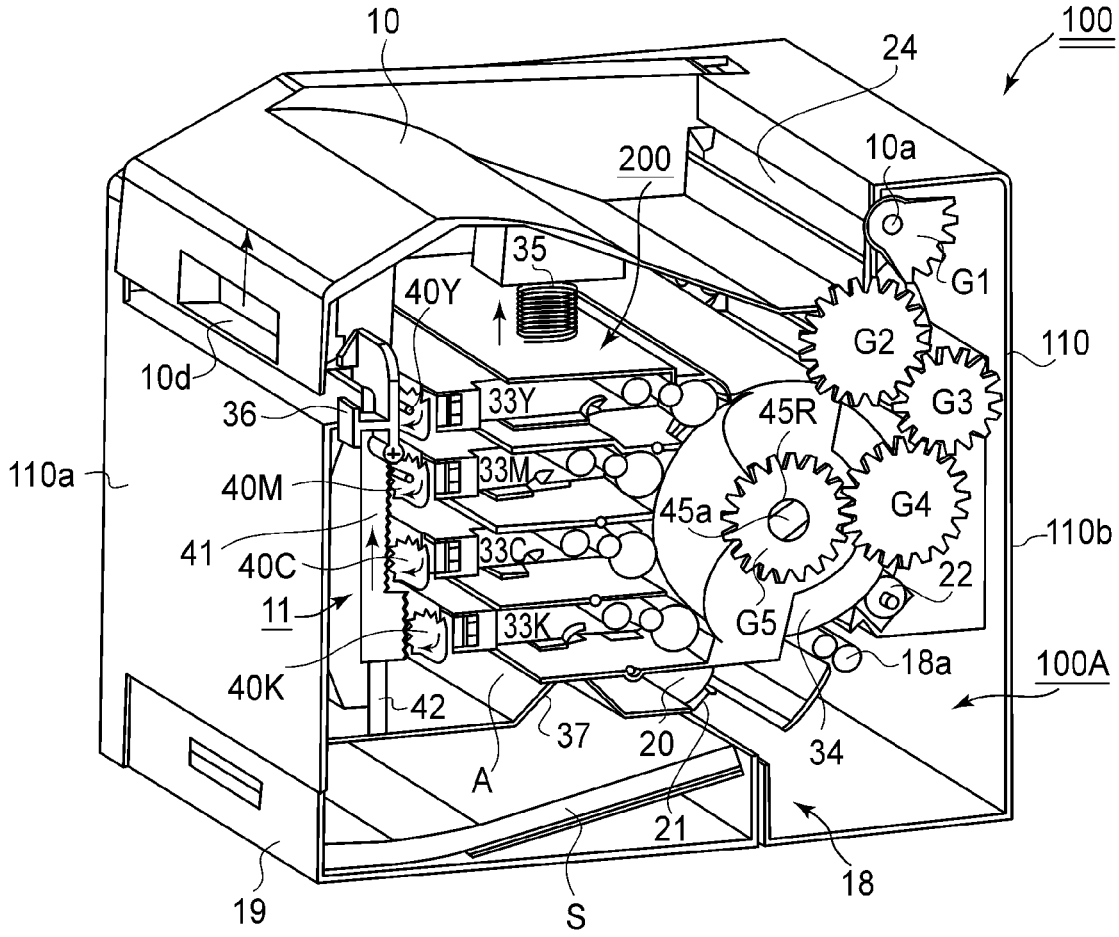
FIG. 8A illustrates the image forming apparatus (1), wherein the cover is partially open.
Figure 8B:
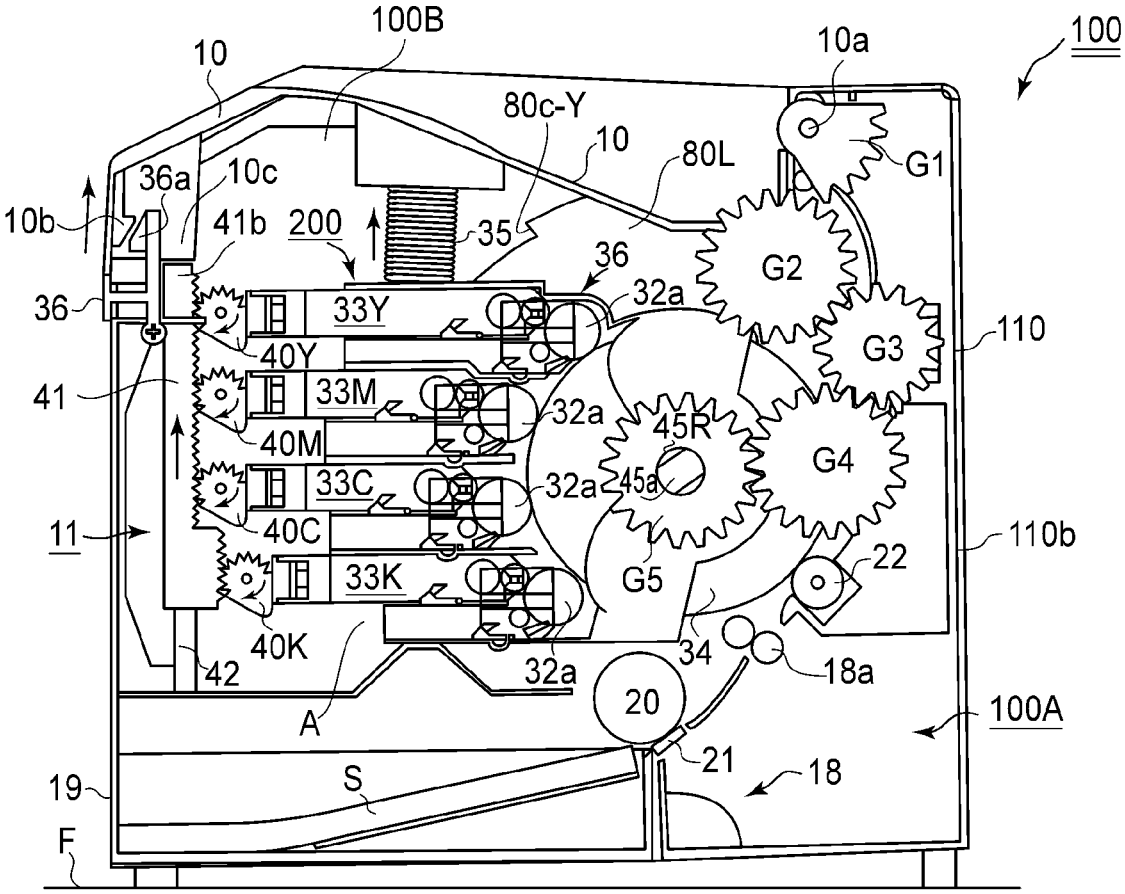
FIG. 8B illustrates the image forming apparatus (2), wherein the cover is partially open.
Figure 9:
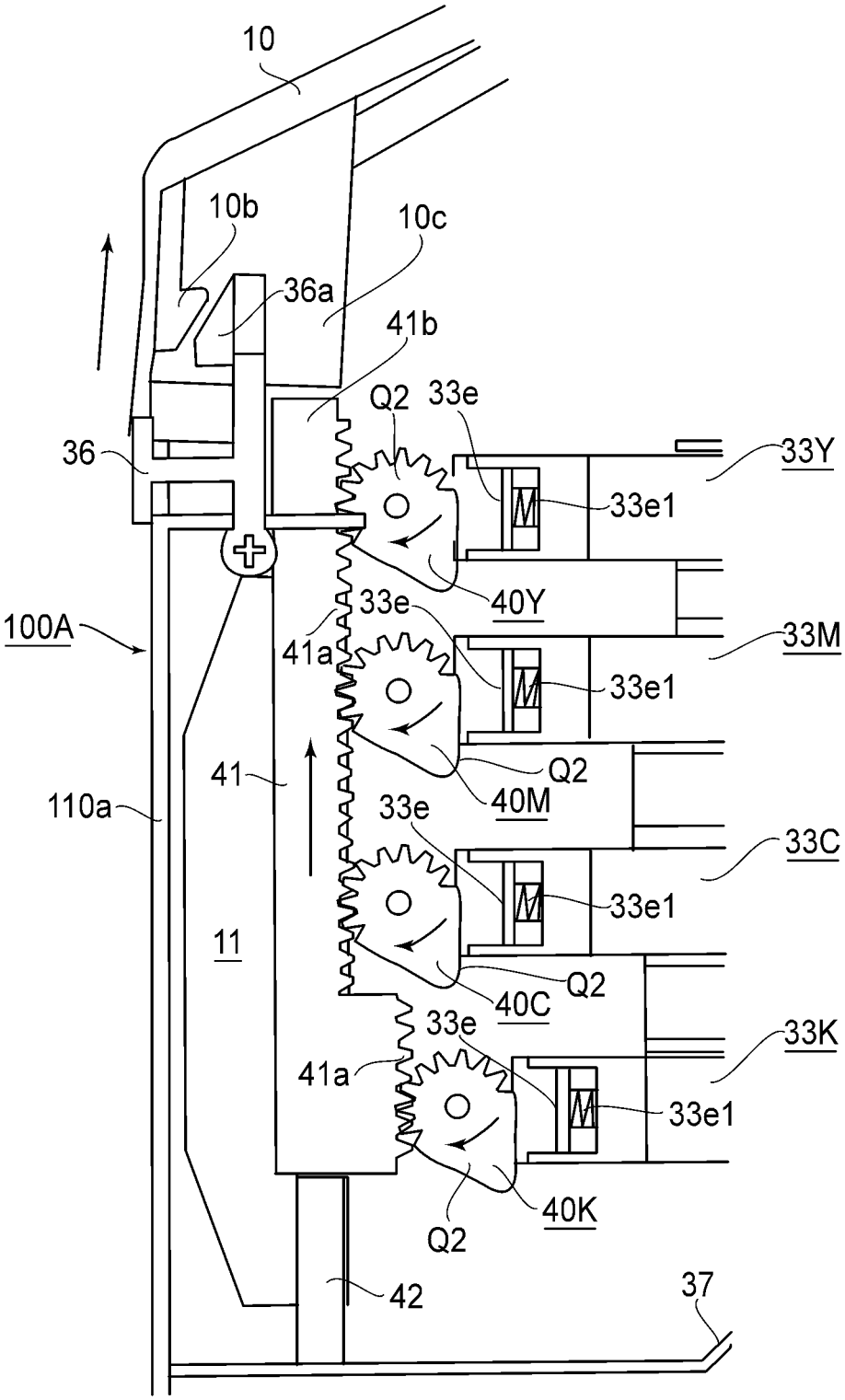
FIG. 9 is a partial enlarged view of FIG. 8B.

The main assembly 100A is provided with a positioning member 40. In the state where the unit 200 is placed in transfer position A, the positioning member 40 is movable between a positioning place Q1 (FIG. 6A, FIG. 6B and FIG. 7) for positioning the cartridge 33 in the predetermined position and a retracted position Q2 (FIG. 8A, FIG. 8B and FIG. 9) retracted from the positioning place Q1. In the state that the cover 10 is closed, the cartridge 33 supported by the unit 200 placed in transfer position A is pushed to the positioning member 40 to be positioned in a predetermined position. More particularly, the cartridge 33 is urged and positioned so that the developing roller 33*b* is positioned relative to the drum 32*a*. FIG. 6A and FIG. 6B show the state in which the urging members 40 (40Y, 40M, 40C, 40K) as the positioning member moves to the positioning place and each cartridge 33 is positioned. FIG. 7 shows a partial enlarged view of FIG. 6B. Referring to FIG. 7, each urging member 40 is disposed correspondingly to each cartridge 33 to the inside of the front frame 110*a* of the main assembly 100A perpendicularly adjacent to each other. Each urging member 40 is rotatable about a supporting shaft 40*a*. Each urging member 40 is provided with a projection 40*b* for pressing the contact unit 33*e* of the cartridge 33 and a gear portion (pinion) 40*c* in the opposite side from the projection (40*b*) side with respect to the supporting shaft 40*a*. A gear portion 40*c* is in meshing engagement with rack teeth 41*a* of a pressing rack 41 as a common interrelating member extended perpendicularly. The pressing rack 41 is perpendicularly slidable in the main assembly 100A. The rack 41 is normally urged upwardly by the elastic force of a spring 42. Each urging member 40 is rotated in the clockwise direction or the counterclockwise direction in FIG. 7 around the supporting shaft 40*a* in the same phase in interrelation with a lowering movement or a rising movement of the rack 41. In the state that the cover 10 is closed, a top end 41*b* of the rack 41 contacts to an inside member 10*c* of the cover 10 to descend to a predetermined lower position against the raising force (elastic force) of the spring 42, and it is held in the lower position. As shown in FIGS. 6A and 6B and FIG. 7, the projection 40*b* of each urging member 40 takes a backward angular attitude (positioning place Q1) opposed to the contact unit 33*e* of the corresponding cartridge 33. By this, each urging member 40 presses the contact unit 33*e* with the predetermined pressure. The cartridge 33 is urged in the direction of the photosensitive unit 32. By this, the cartridge 33 is positioned relative to the photosensitive unit 32. By the positioning of the cartridge 33, the developing roller 33*b* is positioned relative to the drum 32*a*. A unit 33*e* is disposed at a trailing end of the cartridge 33 in the state that the cartridge 33 is mounted to the mounting portion 31*c*. The unit 33*e* is provided with a spring (resilient member) 33*e*1 (FIG. 9). Therefore, the trailing end (unit 33*e*) is urged against the elastic force of a spring 33*e*1 by the urging member 40, by which the cartridge 33 is positioned. Here, the urging members 40 (40Y, 40M, 40C, 40K) as the positioning member and the pressing rack 41 as the interrelating member are provided symmetrically in each of a left-hand side and a right-hand side in the main assembly 100A. The drive inputting portion (unshown) of the intermediary transfer member 34 of the unit 200 placed in transfer position A couples with the drive outputting portion (unshown) in the main assembly side. The drive inputting portions for the photosensitive unit 32 and the cartridge 33 is coupled through the hole portions 80*e*, 80*f*((b) of FIG. 5) of the left guiding plate 80L to the drive outputting portions of the main assembly (100A) side. The electrical contacts of the photosensitive unit 32 and the cartridge 33 are electrically connected to the electric power supply system in the main assembly (100A) side. By this, an image forming operation (print operation) of the image forming apparatus 100 is enabled, and the above-mentioned image forming operation is carried out on the basis of an image formation start signal (print start signal).

According to the embodiment described above, as shown in FIGS. 2A and 2B, the scanner unit 11, the cartridge 33, the drum 32*a*, the transfer member 34, and the feeding path Z for the recording material S are provided substantially along installation surface F. In the upper portion of the apparatus 100, the cover 10 functioning also as the discharging tray is provided, and the cassette 19 is provided in the lower portion of the device 100. The laser beams L (LY, LM, LC, LK) are projected from the unit 11 to the drum 32*a* in the rear part of the cartridge 33. The color developer image transferred onto the intermediary transfer member 34 from each drum 32*a* is transferred onto recording material S in the opposite side from each drum 32*a* with respect to the intermediary transfer member 34. Furthermore, according to this embodiment, the unit 200 can be rotated between the transfer position A (image forming position) and the mounting and dismounting position B in the state that the drum 32*a* is mounted to the unit 200, and the cartridge 33 is dismountably mounted to the unit 200 (mounting portion 31*c*). By rotating the unit 200 to the mounting and dismounting position B from the transfer position A, the cartridge 33 is mounted and demounted relative to the unit 200. According to the embodiment described above, with such a structure, the apparatus 100 can be downsized.

(Exchanging System of Developing Cartridge)

In view of this, for example, the means (unshown) for detecting a remaining amount of the developer of each cartridge 33 is provided in the main assembly 100A. The control circuit portion 300 compares a detected remaining amount value with the threshold for a lifetime forenotice and a lifetime warning of the cartridge 33 preset beforehand. The lifetime forenotice or the lifetime warning of the cartridge 33 is displayed on the display portion 102 of an operating portion 101 (FIG. 1) of the image forming apparatus 100 for the cartridge 33 exhibiting the detected remaining amount value less than the threshold. Or, the lifetime forenotice or the lifetime warning for the cartridge 33 is displayed on the display portion of the external host device 400 (FIG. 2A). By this, a preparation of the cartridge 33 for the exchange is prompted, or, the exchange of the cartridge 33 is prompted for the user. In this embodiment, in an exchange of the cartridge 33 mounted to the unit 200, the opening 100B is exposed by opening the cover 10. In this embodiment, for closure and opening of the cover 10, the user pushes a maintenance button 36 provided on the front side of the main assembly 100A. When the user pushes a button 36 rearwardly against the spring (unshown), the locking claw portion 36*a* on the button (36) side escapes from the locking claw portion 10*b* on cover (10) side backwardly to release the latch engagement. By this, the cover 10 is pushed up by the compressive reaction force (elastic force) of the spring (elastic material) 35 compressed between itself and the upper surface of the sub-frame 31 of the unit 200. The cover 10 is rotated in an open direction from the main assembly 100A by an angle corresponding to an operation distance (restoration length to a free length) of the spring 35 about the hinge shaft 10*a*. More particularly, the cover 10 is automatically partly opened by the elastic force of the spring 35. FIG. 8A and FIG. 8B and FIG. 9 show the partly open state of the cover 10. Thereafter, when the user lifts the finger from the button 36, the force (elastic force) of the urging spring (unshown) restores it to the previous position. At this time, the locking claw portion 10*b* is placed in the upper portion by the partly opening of the cover 10, and therefore, it is not engaged with the locking claw portion 36*a* which has been restored.

By the interrelating mechanism (unshown) in interrelation with the partially opening rotation of the cover 10, the coupling of the drive outputting portion of the main assembly side with the drive inputting portion of the intermediary transfer member 34 of the unit 200 is released. The coupling of the drive outputting portion of the main assembly (100A) side with the photosensitive unit 32 of each cartridge and the drive inputting portion of the developing cartridge 33 is released. The electrical connection of the electric power supply system in the main assembly (100A) with the photosensitive unit 32 of each cartridge P and the electrical contact of the developing cartridge 33 is released. The pressing, to the main stay of the unit 200, 37 of the spring (resilient member) 35 is released by the partially opening rotation of the cover 10. The suppression of the top end 41*b* of the pressing rack 41 by the inside member 10*c* of the cover 10 is released by the partially open rotation of the cover (opening and closing member) 10. By this, the pressing rack 41 rises to a predetermined upper position by the elastic force of the spring (resilient member) 42. In interrelation with the rising movement of the pressing rack 41, each urging member 40 rotates through substantially 90 degrees in the same phase about the supporting shaft 40*a* from the positioning place Q1 shown in FIG. 7 to move to a rotation angle attitude (retracted position Q2) in which the projection 40*b* is downward substantially, as shown in FIG. 9. By this, the projection 40*b* of each urging member 40 separates from the corresponding contact unit 33*e* so that pressing of the contact unit 33*e* by each urging member 40 is released. More particularly, each of the urging member 40 moves to the retracted position Q2 (FIG. 9) retracted from the positioning place Q1 of the corresponding cartridge 33 (FIG. 7). By this, the positioning of the developing cartridge 33 is released.

Figure 11:
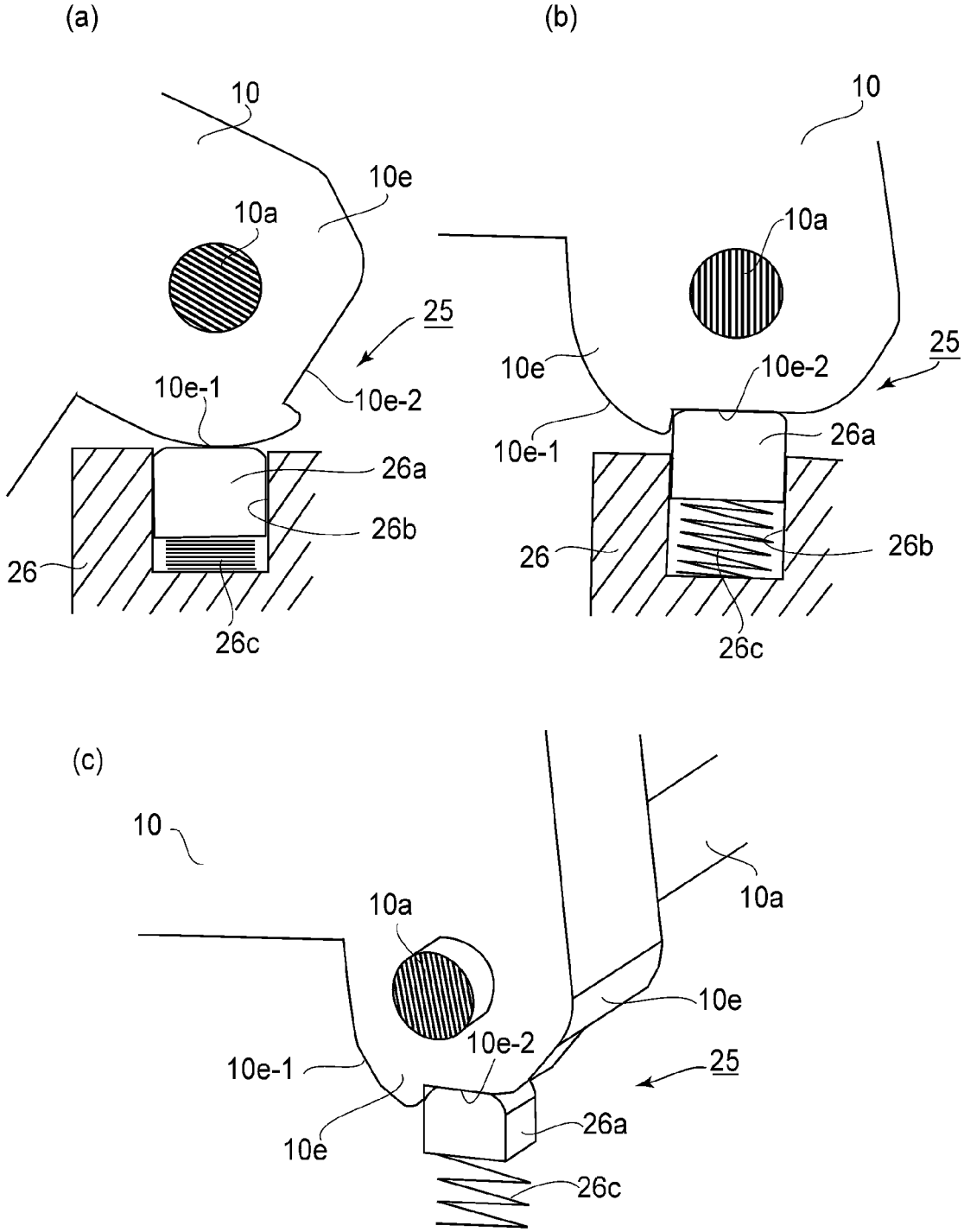
FIG. 11 is an illustration of a click mechanism for the cover.

Then, the user manually operates a grip portion 10*d* of the cover 10, to sufficiently rotate the cover 10 to the predetermined open position for opening the opening portion 100B about the hinge shaft 10*a*. FIG. 10A and FIG. 10B illustrate the state that the cover 10 is opened to the predetermined open position. When the cover 10 is opened to the open position, the open state is maintained by locking means. Thereafter, even if the hand is lifted from the cover 10, the cover 10 is not automatically rotated in the returning direction. The locking means may have another structure. In this embodiment, the locking means has a click stop mechanism 25 as shown in FIG. 11. In (a) of this Figure, the cover 10 is in the closing position, and in (b) and (c), the cover 10 is in the open position. The cover 10 is provided with an integral cam part 10*e*. The stationary member 26 provided in the main assembly 100A is provided with a click protrusion 26*a* normally contacted elastically to the cam portion 10*e*. The protrusion 26*a* is sinkably and projectably inserted in a hole portion 26*b* of the stationary member 26, and it is normally urged elastically in the projecting direction by the elastic force of the raising spring (resilient member) 26*c*. In the state that the cover 10 is in the closing position ((a) of FIG. 11), an arcuate surface portion 10*e*-1 of the cam portion 10*e* is correspondingly to the position of the protrusion 26*a*. The surface portion 10*e*-1 is extended with the center thereof aligned with a shaft axis of the hinge shaft 10*a* (arcuate shape). In the state that the cover 10 is in the open position, ((b) and (c) of FIG. 11), a recess 10*e*-2 of the cam portion 10*e* corresponds to the position of the protrusion 26*a*. The protrusion 26*a* is in engagement with the recess 10*e*-2. The cover 10 is maintained in the open position by this engagement. Therefore, even if the user lifts the hand from the cover 10, the cover 10 is not rotated in the closing direction (returning direction).

The left and right ends of the hinge shaft 10*a* are rotatably supported by the left and right frames 110L, 110R of the main assembly 100A. The cover 10 is unified with this hinge shaft 10*a*. Therefore, the hinge shaft 10*a* is rotated with the opening and closing rotation of the cover 10. The left and right ends of the hinge shaft 10*a* are provided with an integral sector cover gears G1 which are symmetrical in the same phase. The left-hand side cover gear G1 and the left-hand side sub-frame gear G5 are engaged with each other by idle gears G2, G3, G4, and the right-hand side cover gear G1 and the right-hand side sub-frame gears G5 are engaged with each other by idle gears G2, G3, G4. The left-hand side idle gears G2, G3, G4 are rotatably provided on the left-hand side frame 110L of the main assembly 100A. The right-hand side idle gears G2, G3, G4 are rotatably provided on the right-hand side frame 110R of the main assembly 100A. The cover 10 and the image forming unit 200 are rotatable interrelatedly with each other by gear coupling. More particularly, the gears G1-G5 constitute an interrelating member between the cover 10 and the image forming unit 200.

In the state that the cover 10 is in the closing position which closes the opening portion 100A, the sector cover gear G1 is in the angular attitude of not engaging with the idle gear G2, as shown in FIGS. 6A and 6B. More particularly, the cover 10 and the unit 200 are not in the gear connection state. By this, the assured abutment of the unit 200 to the main stay 37 by the spring 35 is maintained irrespective of the position of the cover 10. By this, the unit 200 is positioned to the predetermined position relative to the main assembly 100A. Even when the cover 10 is partly opened by depression of the button 36, the sector cover gear G1 takes the angular attitude of the non-engagement with the idle gear G2, as shown in FIG. 8A and FIG. 8B. More particularly, the cover 10 and the unit 200 are not in the gear connection state. The user operates the grip portion 10*d* of the partly opening cover 10 shown in FIG. 8A FIG. 8B to open the cover 10 by the manual operation to the open position as shown in FIGS. 10A and 10B. When the cover 10 is opened beyond the partly opening angle the cover gear G1 is engaged with the idle gear G2. The continuing rotation force in the open direction for the cover 10 is transmitted from the cover gear G1 through the idle gears G2, G3, G4 to the sub-frame gear G5. By this, the unit 200 rotates in the clockwise direction as seen from the right of the image forming apparatus 100 about the left and right shafts 45L, 45R in the main assembly 100A. By the cover 10 being opened, the top opening 100B of the main assembly 100A is opened. When the cover 10 is sufficiently opened to the open position, the opening state thereof is kept by the click stop mechanism 25 (FIG. 11). By this, the opening portion 100B is opened sufficiently greatly, as shown in FIGS. 10A and 10B. The unit 200 rotates through substantially 45 degrees clockwisely from transfer position A (FIG. 6A and FIG. 6B) to move to the angular attitude in which the cartridge 33 faces to the opening portion 100B (FIGS. 10A and 10B). The unit 200 maintains the angular attitude. More particularly, the unit 200 rotates to the mounting and dismounting position B in interrelation with the movement of the cover 10 to the opening direction where the cartridge 33 can be dismounted through the opening portion 100B. Here, the mounting and dismounting position B is the position in which the user mounts and demounts the cartridge 33 relative to the mounting portion 31*c*. The positioning member 40 moves from the positioning place to the retracted position with the movement of the unit 200 to the mounting and dismounting position B from the transfer position A. The cartridge 33 can be mounted and demounted relative to the mounting portion 31*c* in the mounting and dismounting position B.

Figure 12A:
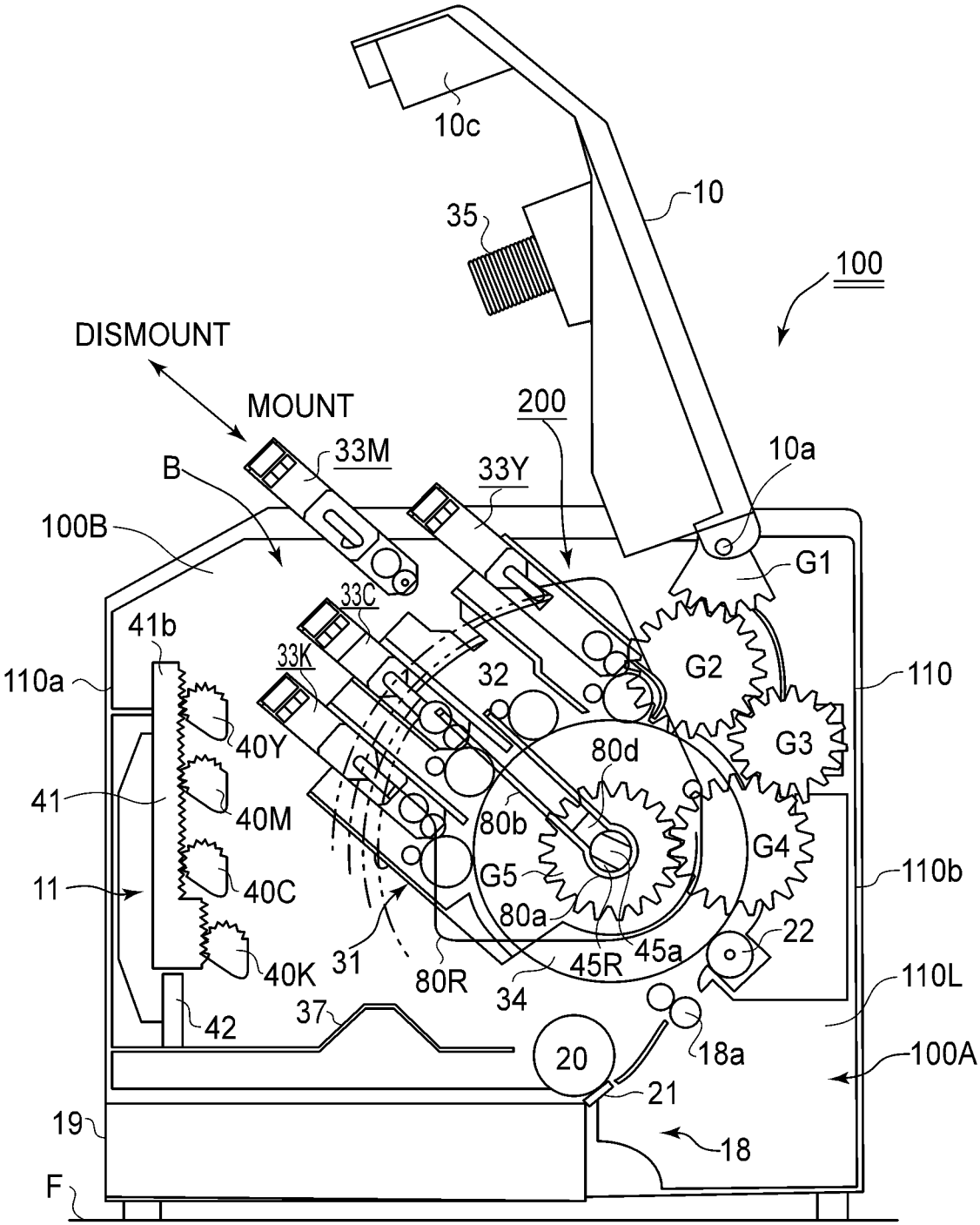
FIG. 12A is an illustration of a mounting and demounting process of the developing cartridge.
Figure 12B:
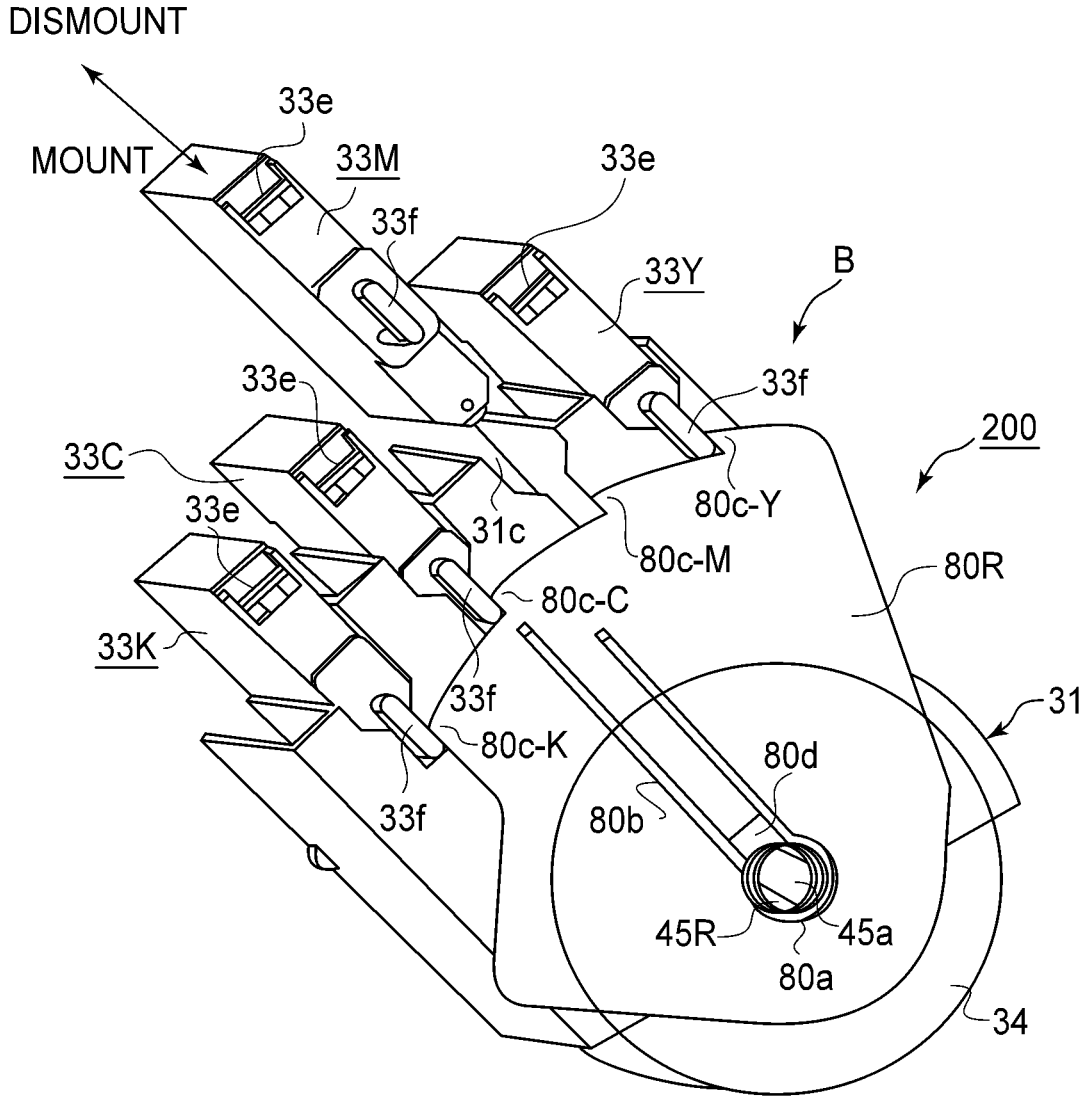
FIG. 12B is a partial enlarged perspective view of FIG. 12A.

According to the embodiment described above, by the user pushing the button 36, the cover 10 opens by a predetermined small angle by the spring. Then, the user moves the cover 10 opened through the predetermined angle to the fully-open position by the manual operation. In interrelation with this movement, the unit 200 moves from the transfer position A to the mounting and dismounting position B. And, in interrelation with this movement, the positioning member 40 moves from the positioning place to the retracted position. Therefore, only if the user moves the cover 10 to the fully-open position by the manual operation, the unit 200 can be moved from transfer position A to the mounting and dismounting position B, and the positioning of the cartridge 33 by the positioning member 40 can be released. Therefore, the mounting and dismounting operativity of the cartridge 33 relative to the mounting portion 31*c* can be improved. With the structure of the image forming apparatus 100 described above, the cartridge 33 can be exchanged, without retracting the scanner unit 11. By this, the user can exchange the cartridge 33 easily. FIG. 12A is a schematic right sectional view of the image forming apparatus including a guiding plate 80R in the mounting and dismounting position B of the unit 200. FIG. 12B is a perspective view of the guiding plate 80R and the image forming unit 200. The cartridge 33 is provided with left and right locking members 33*f*. In the unit 200 which is in the mounting and dismounting position B, the locking member 33*f* is locked with projections 80*c* (80*c*-Y, 80*c*-M, 80*c*-C, 80*c*-K) of the guiding plate 80R when at least one cartridge 33 is mounted to the sub-frame 31. This applies similarly to the left-hand side guiding plate 80L. Here, the locking members 33*f* of the cartridges 33 are provided at the different radial distances from the shaft portions 45L, 45R. For this reason, the cartridges 33 are locked with the projection 80*c* independently from each other.

With the structure described above, when at least one cartridge 33 is mounted to the sub-frame 31 (unit 200), the rotation of the unit 200 is prevented beyond the mounting and dismounting position B (FIG. 12A). At this time, the key-shaped portions 45*a* of the free end portion of the left and right shafts 45L, 45R do not align with the entrance openings 80*d* of the left and right guiding plates 80L, 80R in the direction. For this reason, the sub-frame 31 and the transfer member 34 cannot be dismounted from the main assembly 100A. More particularly, in the case that at least one cartridge 33 is mounted to the unit 200, the unit 200 and the transfer member 34 cannot be dismounted from the main assembly 100A. This is because the unit 200 cannot rotate to the mounting and dismounting position B. When all the cartridges 33 are dismounted from the unit 200 placed in the mounting and dismounting position B, the unit 200 can be dismounted from the main assembly 100A integrally with the transfer member 34 mounted rotatably to the unit 200 ((b) of FIG. 4). In a mounting direction in which the unit 200 is mounted to a main assembly 100*a*, a leading end of the unit 200 is provided with the intermediary transfer member 34, and the trailing end thereof is provided with the mounting portion 31*c*. The side of the unit 200 is provided with a gear G5.

Figure 13A:
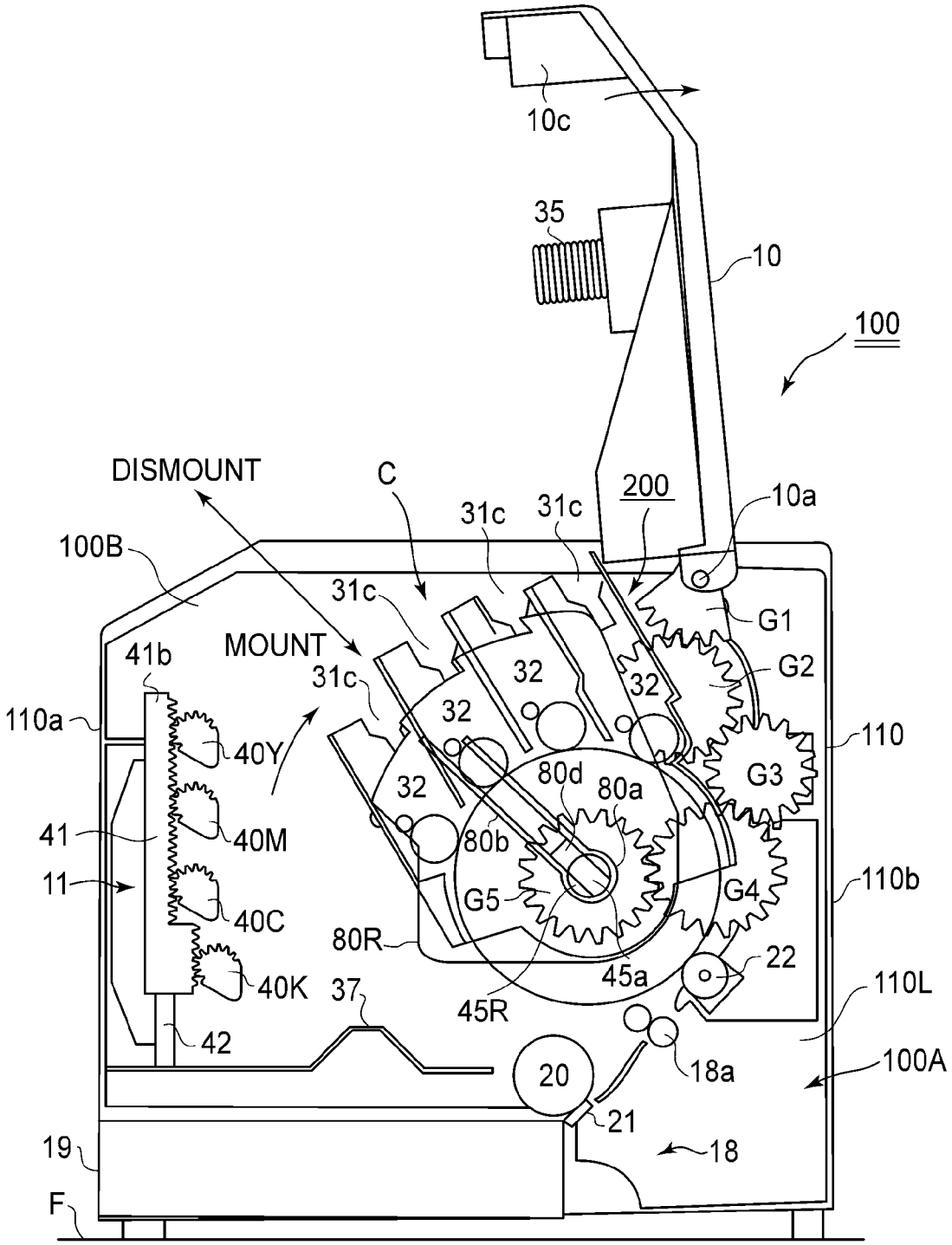
FIG. 13A is an illustration (1) of the mounting and demounting process of a sub frame and an intermediary transfer member.
Figure 13B:
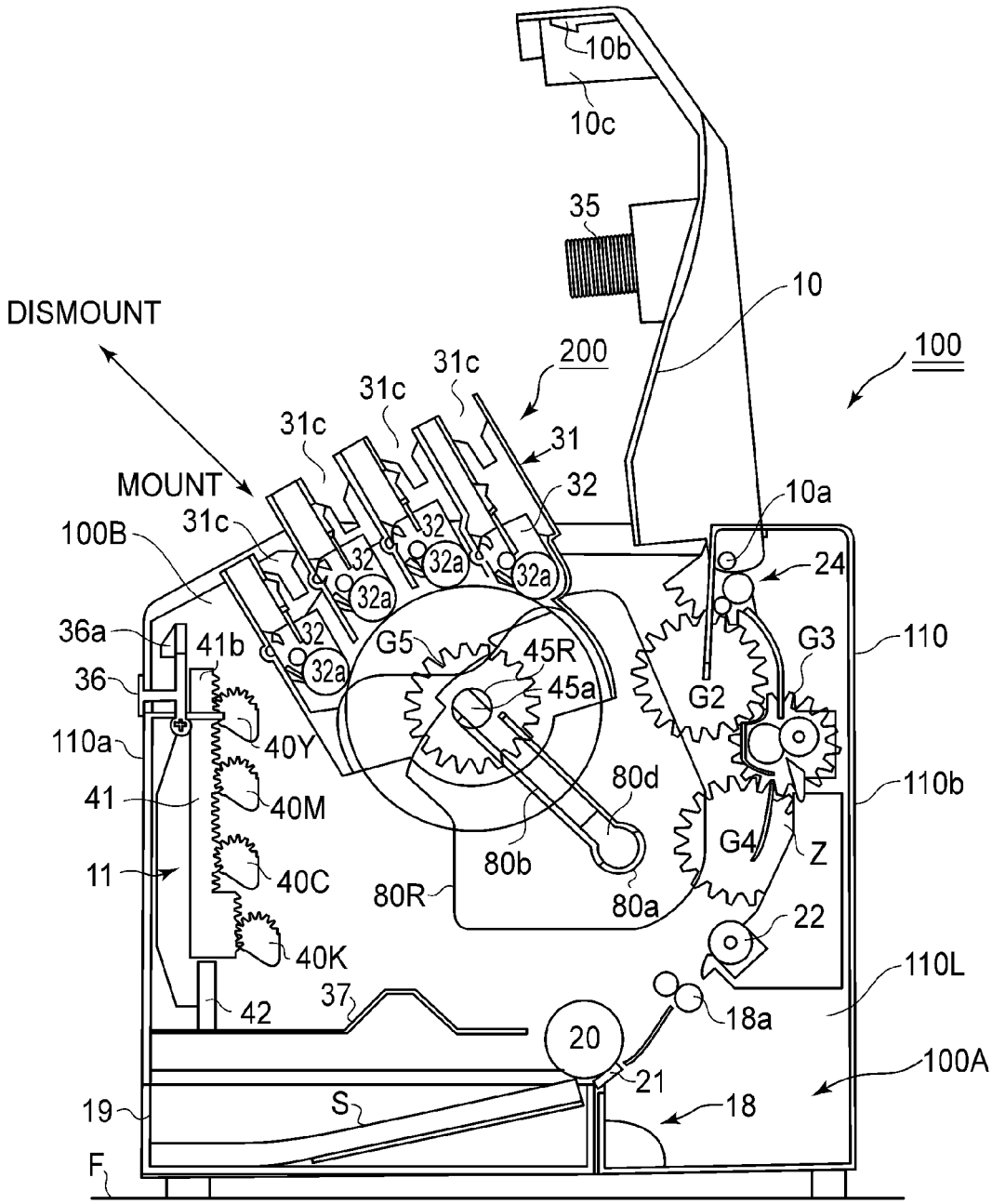
FIG. 13B is an illustration (2) of the mounting and demounting process of the sub frame and the intermediary transfer member.

FIG. 13A is a vertical section right side view of the image forming apparatus 100 in which all of the cartridges 33 are removed, and the sub-frame 31 and the transfer member 34 are dismountable from the main assembly 100A. Since the cartridge 33 is all dismounted from the frame 31 (unit 200 and mounting portion 31*c*), the locking members 33*f* are not locked with the projections 80*c* of the left and right guiding plates 80L, 80R. For this reason, the frame 31 can be rotated further clockwisely from the mounting and dismounting position B (FIG. 12A). More particularly, the frame 31 (unit 200) can be rotated until the key configurations 45*a* of the free end portions of the shaft portions 45L, 45R align with the loading slots 80*d* of the guiding plates 80L, 81R in the direction. The user rotates the frame 31 (unit 200) further clockwisely from the mounting and dismounting position B to move the key configurations 45*a* of the free end portions of the shaft portions 45L, 45R to an angular position C aligned with the entrance openings 80*d* of the guiding plates 80L, 81R, as shown in FIG. 13A. As shown in FIG. 13B, in angular position C, the frame 31 and the transfer member 34 are moved from the main assembly 100A toward the opening portion 100B along the guides 80*b* of the guiding plates 80L, 80R, so that it can be taken out of the main assembly 100A. More particularly, the user moves the unit 200 and the transfer member 34 along the guide 80*b* so that main assembly 100A can be taken out through the opening portion 100B. In addition, the user moves the unit 200 and the transfer member 34 along the guide 80*b* to mount it into the main assembly 100A through the opening portion 100B. In this embodiment, the mounting and demounting of the unit 200 relative to the main assembly 100A is carried out in the state that the cartridge 33 is not mounted to the unit 200. Therefore, in mounting and demounting the unit 200 relative to the main assembly 100A, the damage of the cartridge 33 can be prevented.

Here, when the frame 31 (unit 200) is further rotated from the mounting and dismounting position B (FIG. 12A) to the position C clockwisely, the rotation force is transmitted from a frame gear G5 through the idle gears G4, G3, G2 to the cover gear G1. For this reason, it further rotates in the open direction from the open position in which the cover 10 is held by the click stop mechanism 25. At this time, the further rotation of the cover 10 in the open direction is permitted by the sinking of the click protrusion 26*a*. Therefore, no straining force is applied to the gears G1-G5. By this, the frame 31 (unit 200) and the transfer member 34 can be taken out of the main assembly 100. The transfer member 34 can be removed from the intermediary transfer frame 31*a* (FIG. 2B) provided in the frame 31 (unit 200). By removing the transfer member 34 from the frame 31*a*, the photosensitive unit 32 can be removed from the supporting unit 31*b* (FIG. 2B). By this, as needed, the transfer member 34 or/and the photosensitive unit 32 can be exchanged with the new one relative to the frame 31. Through the reverse process, the frame 31 and the transfer member 34 can be mounted into the main assembly 100.

In this embodiment, the unit 32 is dismountable relative to the unit 200. In such a case, the unit 32 can also be called process cartridge. This is because, the drum 32*a*, the charging roller 32*b* and the cleaning blade 32*c* as the process means are unified, and the unit is detachably mountable to the main assembly 100A. However, the unit 32 maybe securedly fixed to the unit 200. In this embodiment, when the unit 32 are securedly fixed to the unit 200, four sets of the drum 32*a*, the charging roller 32*b*, the cleaning blade 32*c* as the process means are provided. The unit 200 unifies them and is dismountably mounted to the main assembly 100A. Therefore, in the case of such a structure, the unit 200 can also be called process cartridge. In FIG. 2B, designated by b is a locking claw (locking portion, projecting member) and is provided on the unit 32. Designated by a is a locking claw (locking portion, resilient member) and is provided on the unit 200. By the releasable locking between the locking claw b and the locking claw a, the unit 32 is dismountably mounted to the unit 200. However, this embodiment is not limited to this example. For example, the claw (locking portion) provided on one side maybe elastically and releasably locked with the hole (locking portion) provided in another side.

A unit 200 is rotated about the rotation axis 34*a* of the transfer member 34 to move between the transfer position A and the mounting and dismounting position B. At the time of an image formation (image transfer) and during the dismounting operation of the cartridge 33, the transfer member 34 is positioned by the shaft portions 45L, 45R and the positioning portion 80*a*. For this reason, the rattling of the transfer member 34 is suppressed. The shaft portions 45L, 45R are provided on the frame 31. The positioning portions 80*a* are provided on the guiding plates 80L, 80R, respectively. The transfer member 34 is cylindrical, and the unit 200 rotates about the center axis of the drum 34. More particularly, the unit 200 is rotated co-axially with the drum 34. By this, the spacing required to move the unit 200 between the transfer position A and the mounting and dismounting position B can be reduced. Therefore, the image forming apparatus 100 is downsized. If all the cartridges 33 mounted to the unit 200*s* are not dismounted, the transfer member 34 and the unit 200 (sub-frame 31) cannot be removed from the main assembly 100A. By this, at the time of the exchange of the cartridge 33, the transfer member 34 which is less frequently exchanged can be prevented from being removed inadvertently. When the cartridge 33 and the transfer member 34 are integrally dismounted from the main assembly 100A, there is a liability that the cartridge 33 or the transfer member 34 may disengage, but this can also be prevented according to the present invention.

A process will be described in which after the cartridge 33 is exchanged in the state where the unit 200 is placed in the mounting and dismounting position B, the unit 200 is again moved to the transfer position A. As shown in FIG. 12A and FIG. 12B, the cartridge 33 is inserted into the mounting portion 31*c* of the unit 200 placed in the mounting and dismounting position B. By this, the cartridge 33 is temporarily held on the mounting portion 31*c* by the engagement between the resilient member c (FIG. 2B) provided on the mounting portion (31*c*) side and the projecting member d provided on the cartridge (33) side. After the exchange of the cartridges 33, the user rotates the cover 10 which is in the open position in the closing direction against the clicking engagement force of the click stop mechanism 25. In interrelation with the rotation of the cover 10 in the closing direction, the unit 200 rotates in the counterclockwise direction (FIG. 12A) about the shaft portions 45L, 45R. In this case, the moving force of the cover 10 is transmitted to the unit 200 through the gears G1-G5. Here, the gears G1-G5 are a fourth interrelating member. When the cover 10 is closed to the neighborhood of the partly-open position, the engagement of the cover gear G1 with the idle gear G2 is released. More particularly, the gear coupling between the cover 10 and the unit 200 is released. For this reason, the unit 200 is rotated counter-clockwisely about the shaft portions 45L, 45R by the weight. The unit 200 is supported on the main stay 37. More particularly, the unit 200 is placed in the transfer position A. By the further rotation of the cover 10 in the closing direction, the spring 35 provided on the inner surface of the cover 10 contacts to the upper surface of the frame 31. The user moves the cover 10 to the closing direction while pushing and contracting the spring 35, until the locking claw portion 10*b* provided on the cover 10 engages with the locking claw portion 36*a* of the button 36. If a claw portion 10*b* engages with a claw portion 36*a*, the cover 10 maintains the closed state.

By the interrelating mechanism (unshown) in interrelation with the rotation of the cover 10 in the closing direction from the partly-open position to the closed position, the drive outputting portion (unshown) of the main assembly side couples with the drive inputting portion (unshown) of the transfer member 34. The drive outputting portions (unshown) of the main assembly (100A) side is coupled to the drive inputting portions (unshown) of the photosensitive unit 32 and the cartridge 33. The electrical contacts on main assembly (100A) side connect to the electrical contacts of the photosensitive unit 32 and the cartridge 33. The unit 200 is positioned and maintained at the transfer position A (FIGS. 2A and 2B) by the compressive reaction force of the spring 35 in the state that the frame 31 is locked with the stay 37. While rotating in the closing direction from the partly-open position of the cover 10 to the closed position, the inside member 10*c* of the cover 10 contacts to the top end 41*b* of the pressing rack (third interrelating member) 41 raised by the elastic force of the spring (resilient member) 42. By the continuing rotation of the cover 10 in the closing direction, the rack 41 lowers to the predetermined lower position against the raising force of the spring 42. By this, the cover 10 is maintained in the closed position, by which the cover 10 is maintained in the lower position. In interrelation with the lowering movement of the rack 41, each urging member (positioning member) 40 moves from the retracted position Q2 (FIG. 9) to the positioning place Q1 (FIG. 7). By this, the unit 33*e* of the cartridge 33 is pressed with the predetermined pressure by each urging member 40. Therefore, the cartridge 33 is urged toward the unit 32 to be positioned relative to the unit 32. More particularly, by the positioning of the cartridge 33, the developing roller 33*b* is positioned relative to the drum 32*a*.

By this, the image forming apparatus 100 returns to the state shown in FIG. 6B to enable the image forming operation. Here, in the image forming apparatus 100 described above, each urging member 40 may also have the function as the electrical contact for supplying a bias voltage to the developing roller 33*b*. The gear portion 40*c* maybe integral or unintegral with the urging member 40. A combination of the gears maybe employed in place of a rack-and-pinion, by which the positioning member is moved between the positioning place and the retracted position. The gear G1 and the gear G5 are integral or unintegral with the cover 10 and the frame 31. The interrelated operation between the cover 10 and the unit 200 maybe accomplished by the structure of the combination of the rotation and the linear motion such as the rack-and-pinion. In this embodiment, the exchangeable cartridge is a developing cartridge 33. However, it maybe the process cartridge integrally containing the photosensitive unit 32 and the cartridge 33.

The structure of the image forming apparatus 100 of the above-described Embodiment 1 is summarized as follows. The apparatus is an electrophotographic color image forming apparatus 100 for forming a color image on recording material S. It includes two or more cartridge mounting portions 31*c* for mounting the cartridge 33 dismountably. It further includes an independent intermediary transfer member opposed to a plurality of electrophotographic photosensitive drums 32*a*, and the developer images formed in the electrophotographic photosensitive drums 32*a* are transferred onto an intermediary transfer member. The apparatus includes an image forming unit 200 including two or more cartridge mounting portions 31*c* and the transfer member 34. The image forming unit 200 is movable between the transfer position A for transferring the developer image transferred onto the transfer member 34 from the drums 32*a* onto recording material S, and the cartridge mounting and dismounting position B for mounting and demounting the cartridge 33 relative to the cartridge mounting portion 31*c*. The unit 200 can take an intermediary transfer member mounting and dismounting position C for mounting and demounting the transfer member 34 relative to the main assembly 100A of a color electrophotographic image forming apparatus. It is provided with unit movement regulating means 80*c* (80*c*-Y, 80*c*-M, 80*c*-C, 80*c*-K). In the case of not mounting the cartridge 33 to any of two or more cartridge mounting portions 31*c*, the unit movement regulating means 80*c* permits the unit 200 to move to the intermediary transfer member mounting and dismounting position C. In the case of the cartridge 33 being mounted to at least one of the two or more mounting portions 31*c*, the unit movement regulating means 80*c* moves the unit 200 to mounting and dismounting position C. The cartridge 33 is provided with cartridge side engaging members 33*f* (33 *f*-Y, 33 f-M, 33 *f*-C, 33 *f*-K). The unit movement regulating means is the main assembly side engaging members 80*c* (80*c*-Y, 80*c*-M, 80*c*-C, 80*c*-K) provided in the main assembly 100A. In the state that the cartridge 33 is mounted to the mounting portion 31*c*, and a cartridge side engaging member and main assembly side engaging member are in engagement with each other, an engaging member 80*c* prevents the unit 200 from the movement to mounting and dismounting position C.

The apparatus further includes an opening portion 100B for permitting the mounting and demounting of the cartridge 33 relative to the mounting portion 31*c* of the unit 200 placed in the mounting and dismounting position B. It is provided with the cover 10 movable between the closed position for closing the opening portion and the open position for opening the opening portion. In addition, it is provided with interrelating members G1-G5. The interrelating members G1-G5 moves the unit 200 from the transfer position A to the mounting and dismounting position B in interrelation with the cover 10 moving from the closed position to the open position by the manual operation. The interrelating members G1-G5 move the unit 200 from the mounting and dismounting position B to the transfer position A in interrelation with the movement of the cover 10 to the closed position from the open position by the manual operation. The unit 200 is moved between a cartridge mounting and dismounting position B, a transfer position A, and an intermediary transfer member mounting and dismounting position C about the rotation axis 34*a* of the intermediary transfer drum as the transfer member 34. The a plurality of electrophotographic photosensitive drums 32*a* are provided in the unit 200. And, the cartridge 33 is a developing cartridge which is provided with the developing roller 33*b* for developing the electrostatic latent image formed on the electrophotographic photosensitive drum 32*a*. The developing cartridge 33 is mounted to the mounting portions 31*c*, so that the developing roller 33*b* is placed opposed to the electrophotographic photosensitive drums 32*a*, respectively. In the state that the unit 200 is placed in transfer position A, the developing roller 33*b* develops the electrostatic latent image in the state that it is spaced with the gap a ((b) of FIG. 3) from the electrophotographic photosensitive drum 32*a*.

Embodiment 2

Figure 14:
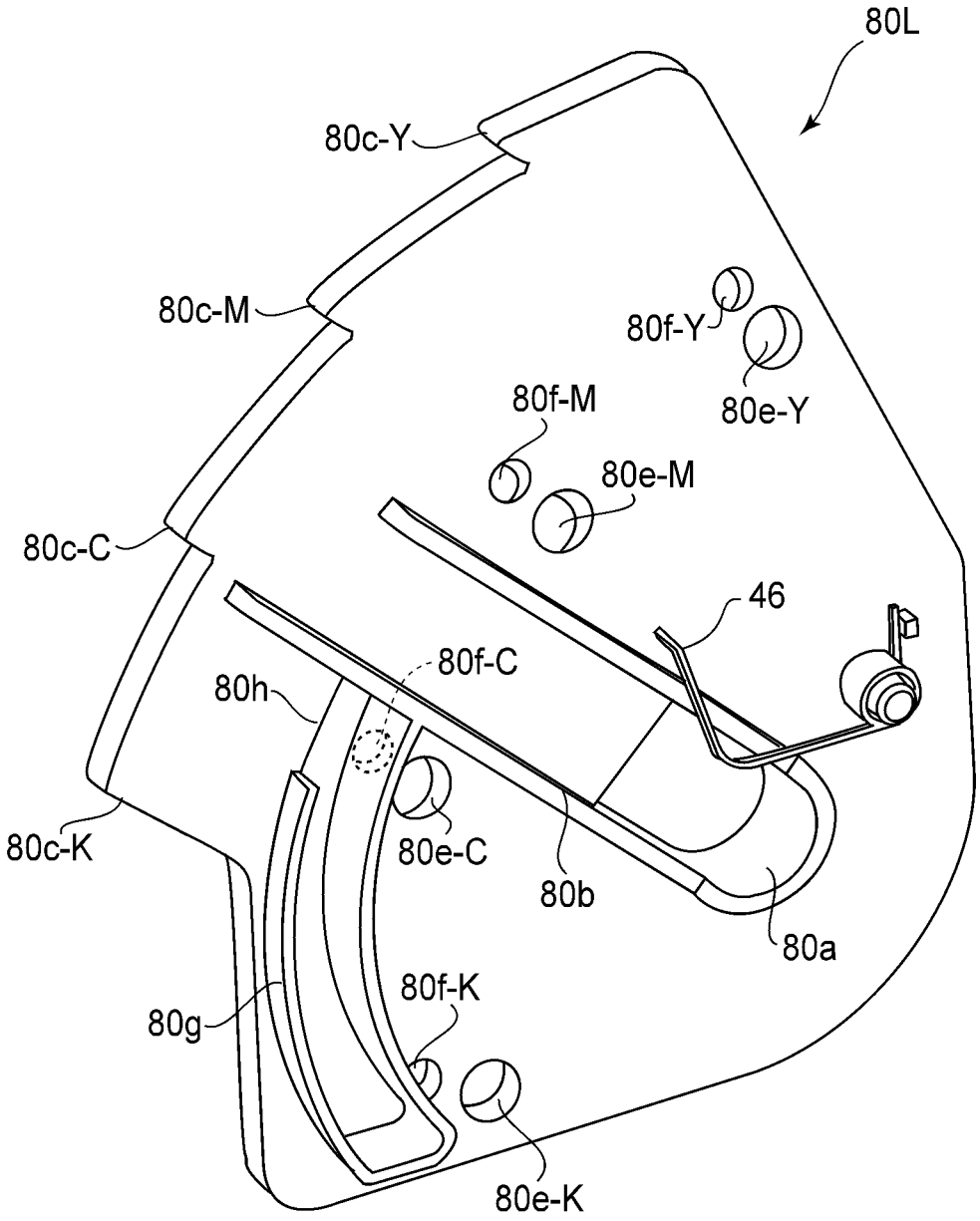
FIG. 14 is a perspective view of an inner side of a left guiding plate in the image forming apparatus of Embodiment 2.
Figure 15:
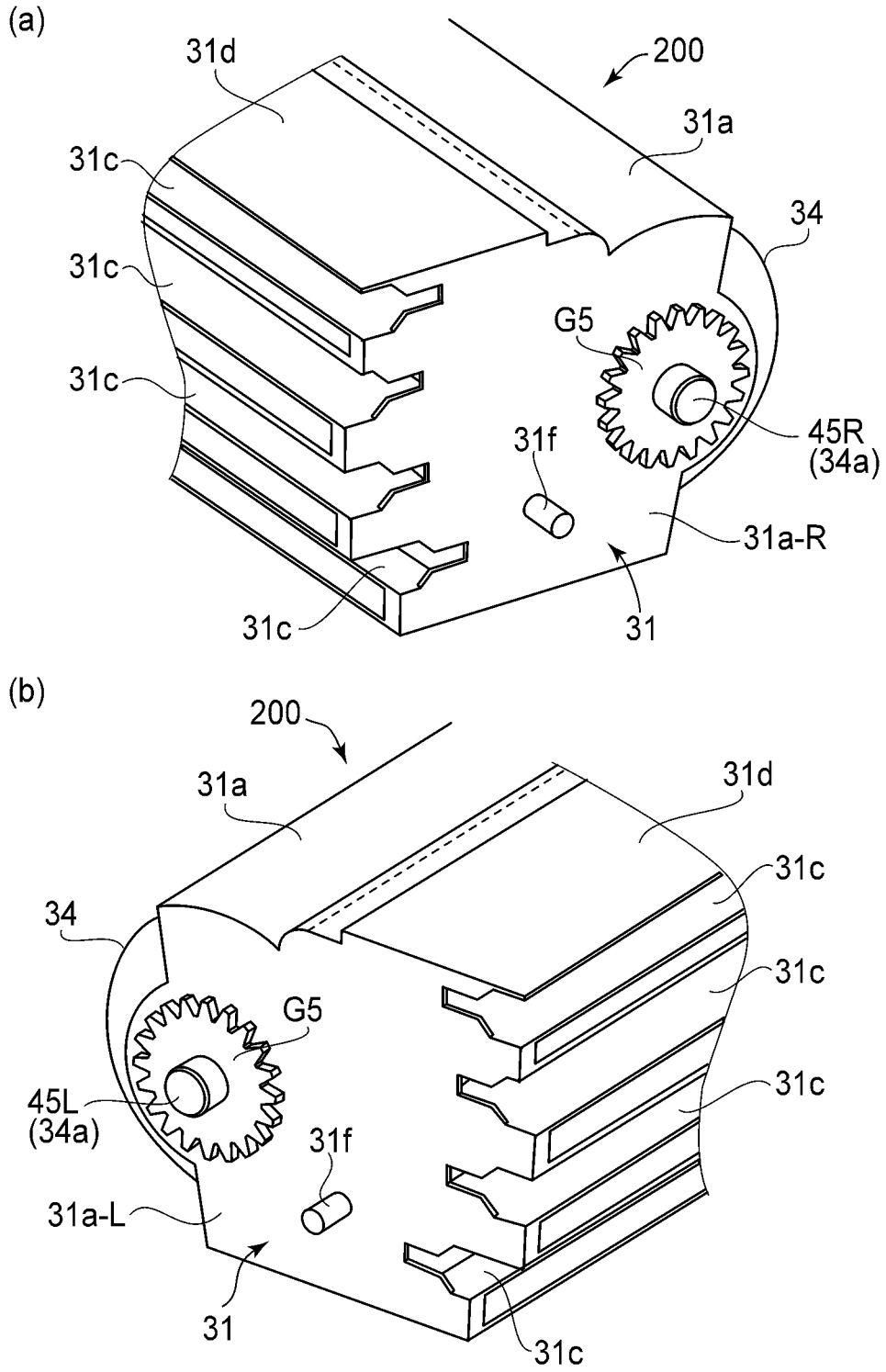
FIG. 15 is a perspective view of the substantially right-half part (a) and left-half part (b) of the unit 200 in the state that the cartridges 33 are dismounted.
Figure 16A:
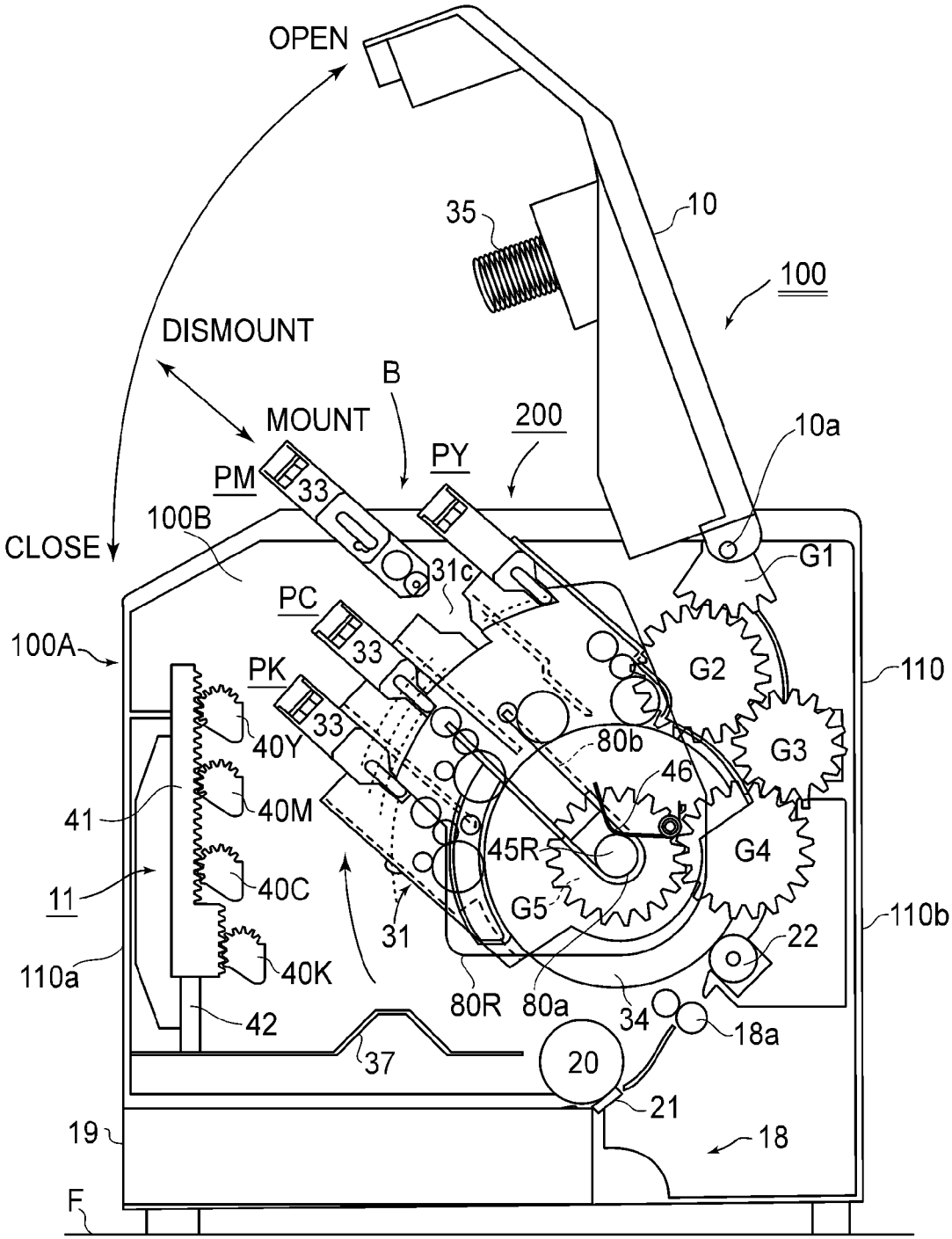
FIG. 16A illustrates the image forming apparatus, wherein the cover is opened to the open position and the image forming unit is in the mounting and dismounting position.
Figure 16B:
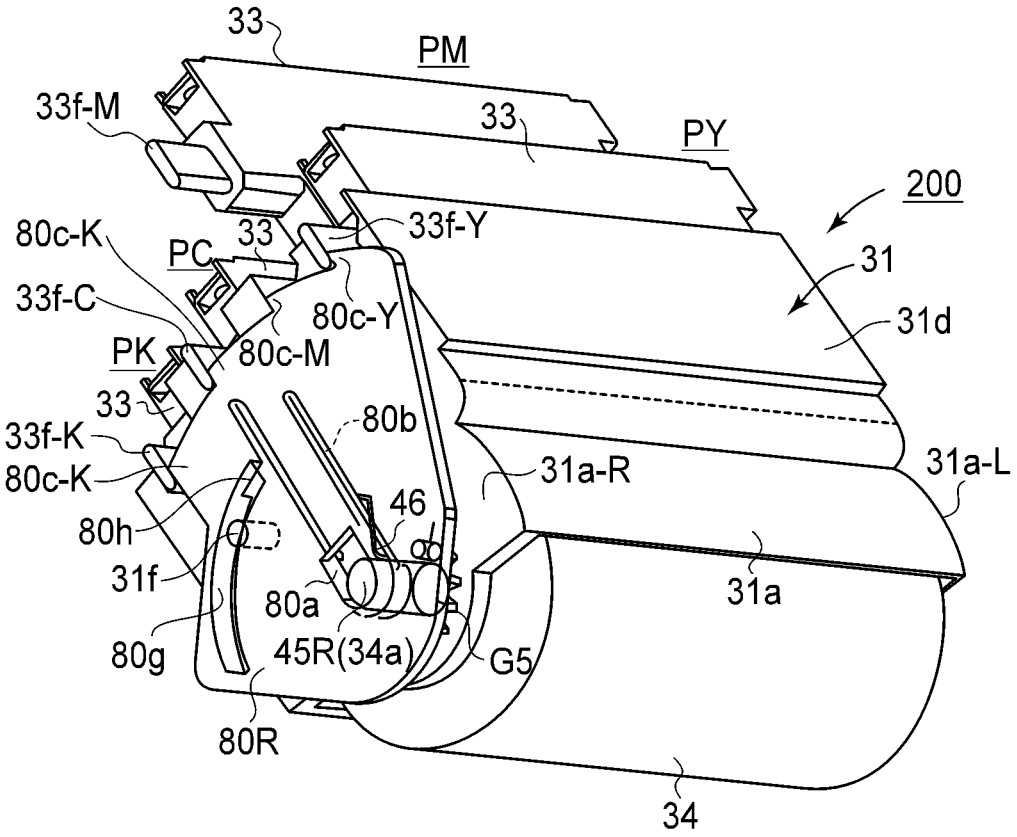
FIG. 16B is a partial enlarged perspective view of FIG. 16A.
Figure 17:
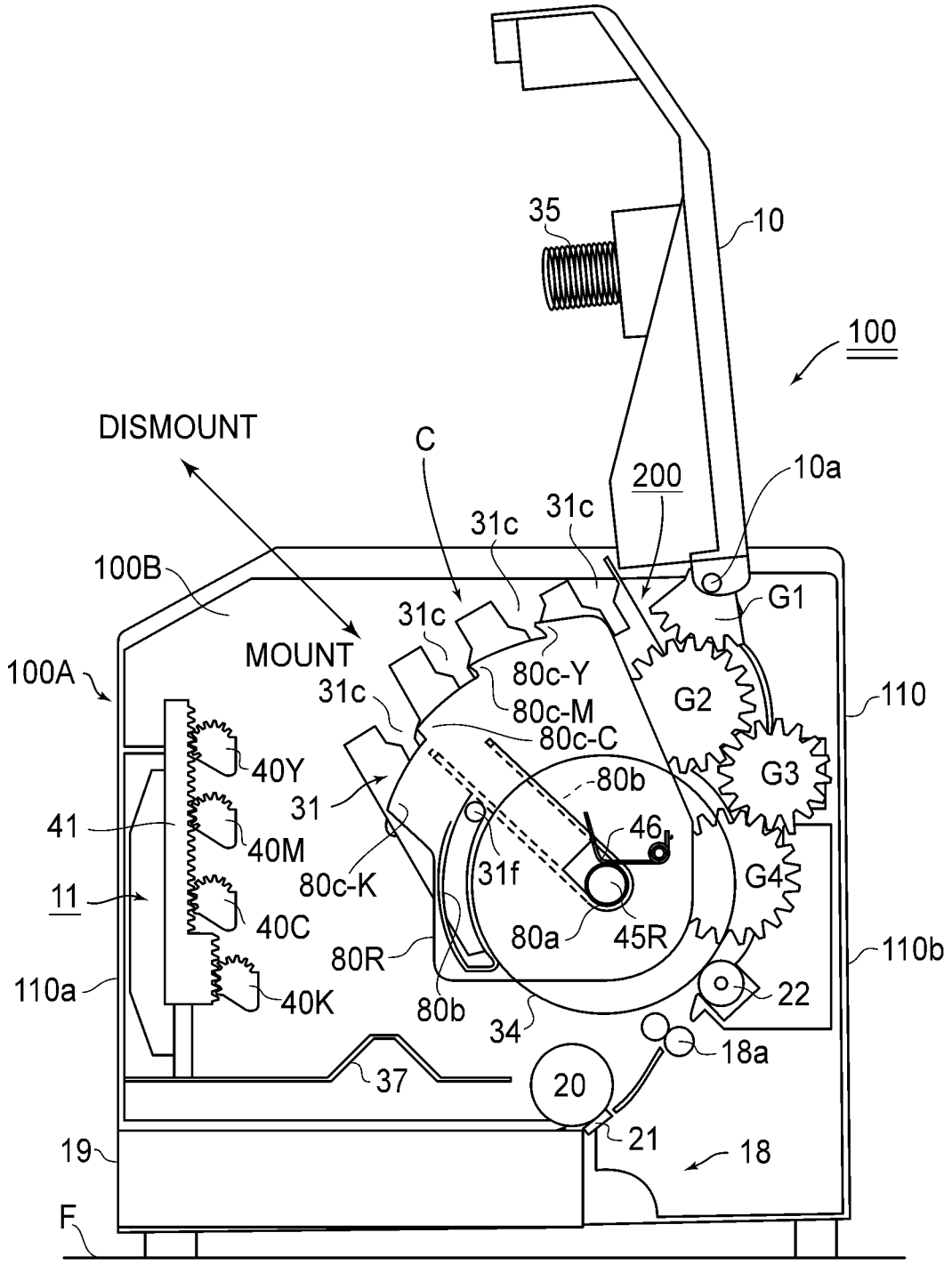
FIG. 17 illustrates the image forming apparatus (2), wherein the image forming unit is in the intermediary transfer member mounting and dismounting position.
Figure 18:
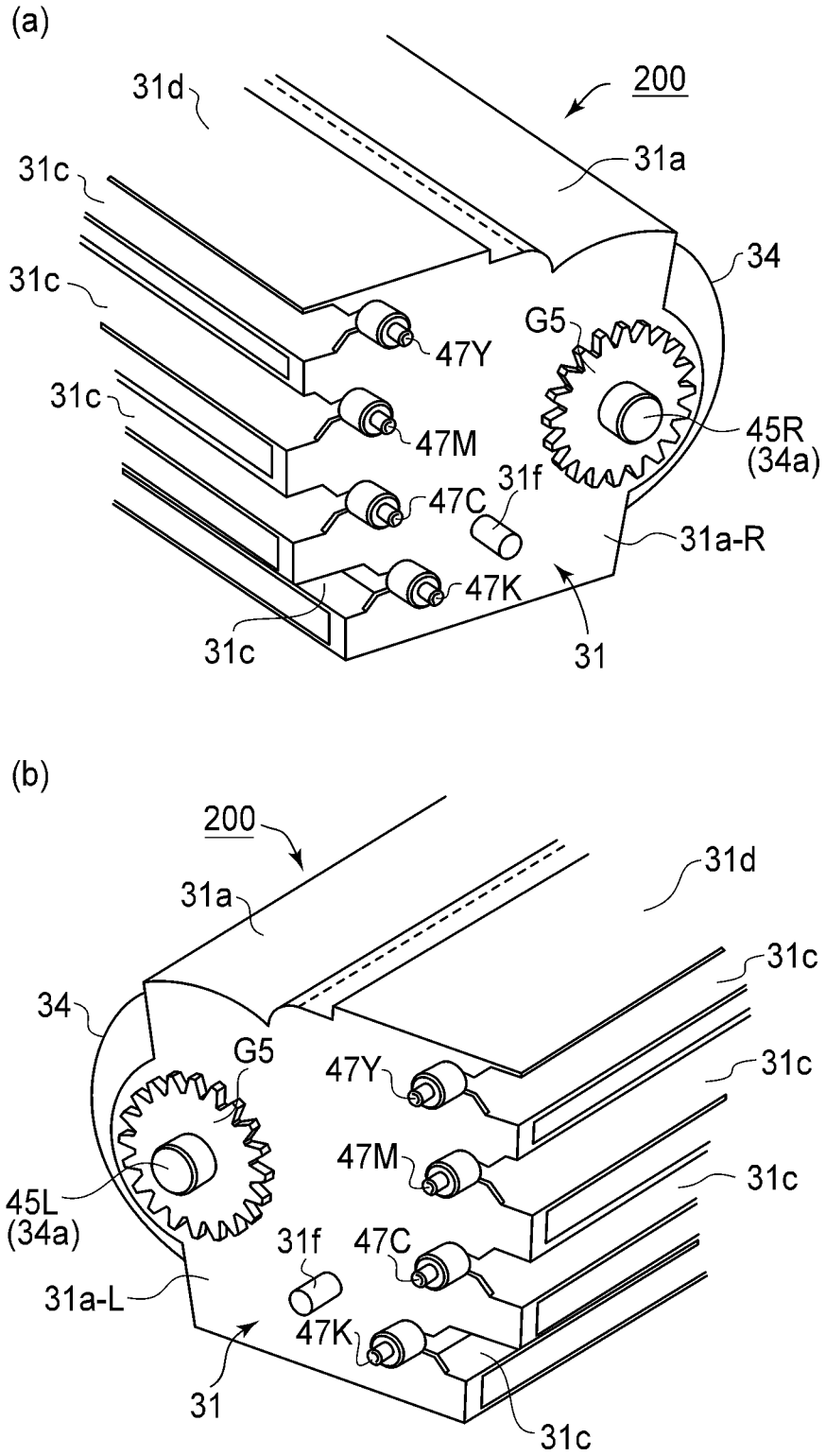
In FIG. 18 is a partial view of the image forming apparatus of Embodiment 2, wherein (a) and (b) are perspective views of the right-hand side half part and left-hand side half part of the image forming unit in the state that the developing cartridge is dismounted.
Figure 19:
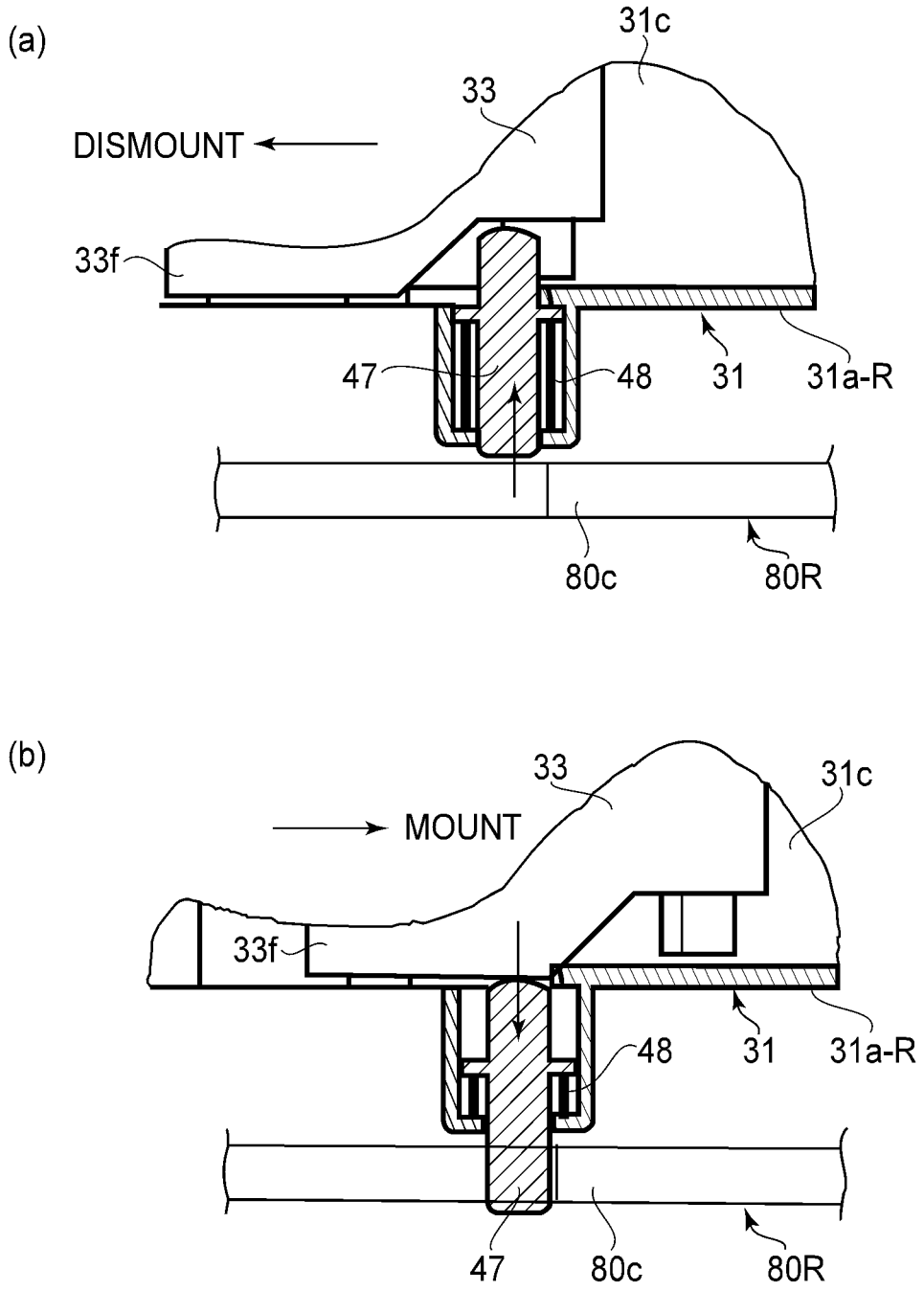
FIG. 19 is an illustration of an operation of a pin which is an image forming unit side movable member.

FIG. 14-FIG. 17 illustrate the image forming apparatus 100 of Embodiment 3. According to this embodiment, in the state that the unit 200 is placed in transfer position A and mounting and dismounting position B, the removal of the transfer member 34 from the main assembly 100A is prohibited. In the state that the transfer member 34 is placed in mounting and dismounting position C, the removal is permitted by the key configuration 45*a* and the entrance opening 80*d*. This embodiment employs another example of the structure for such a regulation and permission. The like reference numerals as in Embodiment 1 are assigned to the elements having the corresponding functions 1-3, and the detailed description thereof is omitted for the sake of simplicity. FIG. 14 is a perspective view of the inner side of the left guiding plate 80L. Similarly to Embodiment 2, it is provided with the positioning portion 80*a* for receiving the shaft portion 45L of the sub-frame 31, the guide 80*b* for guiding the shaft portion 45L, the projection 80*c*, the hole portion 80*e*, and the hole portion 80*f*. Furthermore, it is provided with a spring 46 for constraining the rising of the shaft portion 45L in a mounting of the sub-frame 31. Furthermore, it is provided with a rib (second main assembly side engaging portion) 80*g*, and the rib 80*g* is cut partially to provide an opening portion 80*h*. Also, a right guiding plate 80R is provided with the positioning portion 80*a* for receiving a shaft portion 45R of the sub-frame 31, the guide 80*b* for guiding the shaft portion 45R, and the projection 80*c*, symmetrically with the left guiding plate 80L. Furthermore, it is provided with a spring 46 for suppressing the rising of the shaft portion 45R, in the mounting of the sub-frame 31. (a) and (b) of FIG. 15 are perspective views of the substantially right-half and left-half parts of the unit 200 of the state that the developing cartridges 33 of the cartridges P are dismounted. The outsides of the left side plate 31*a*-L and the right side plate 31*a*-R of the frame 31*a* are provided with the symmetrical bosses (unit side engaging portions) 31*f*, and they oppose to the ribs 80*g* of the left and right guiding plates 80L, 80R. FIG. 16A is a right side longitudinal sectional view of the image forming apparatus 100 in the state that the cover 10 is manually rotated to the open position, and the unit 200 has been moved from transfer position A to the mounting and dismounting position B. FIG. 16B is a perspective view of the guiding plate 80R and the image forming unit 200 in the state of FIG. 16A. Similarly to Embodiment 2, the locking member 33*f* which is the cartridge side engaging member is contacted to the projection 80*c* of the guiding plate 80 as the main assembly side engaging member which is the unit movement regulating means. By this, the further rotation of the unit 200 is prevented. In other words, the unit 200 is not moved to the mounting and dismounting position C from the mounting and dismounting position B. At this time, a boss 31*f* of the sub-frame 31 is prevented by the rib 80*g* of the guiding plate 80. For this reason, the unit 200 cannot be pulled out. In other words, in the state that the unit 200 is placed in the transfer position A and the mounting and dismounting position B, the boss 31*f* and the rib 80*g* engage with each other. By this, the dismounting of the transfer member 34 from the main assembly 100A is prohibited. FIG. 17 is a right side longitudinal sectional view of the image forming apparatus 100, wherein the sub-frame 31 and the transfer member 34 is dismountable from the main assembly 100A. When the developing cartridge 33 is removed altogether, the unit 200 (frame 31 and intermediary transfer unit 34) can be moved to the mounting and dismounting position C from the mounting and dismounting position B, without the boss 31*f* being prevented by the rib 80*g*. In other words, by pushing the spring 46 open, the unit 200 can be mounted to the main assembly 100A along the guide 80*b*. According to this embodiment, it is desirable to employ a part for preventing shakiness of the shaft portion 45 such as the spring 46. However, the boss 31*f* is disposed with a distance from the shaft portion 45. By this, the positional difference of the bosses 31*f* due to the angular difference between the mounting and dismounting position B and the mounting and dismounting position C of the unit 200 can be increased. Therefore, the mountability and dismountability of the unit 200 by the rib 80*g* is set assuredly.

The structure of the image forming apparatus 100 of the above-described Embodiment 2 is summarized as follows. The fundamental structure is the same as those of the image forming apparatus 100 of Embodiment 1. The unit 200 is provided with the unit side engaging member 31*f*. The main assembly 100A is provided with the second main assembly side engaging member 80*g*. In the state that the unit 200 is placed in the transfer position A and the mounting and dismounting position B, the unit side engaging member 31*f* and the second main assembly side engaging member 80*g* engage with each other. By this, the dismounting of the transfer member 34 from the main assembly 100A is prevented. In the state that the unit 200 is placed in the mounting and dismounting position C, an engaging member 31*f* and an engaging member 80*g* is not engaged with each other. By this, the dismounting of the transfer member 34 from the main assembly 100A is permitted.

FIG. 18-FIG. 21A illustrate the image forming apparatus 100 of Embodiment 3. The present Embodiment 3 is different from the image forming apparatus 100 of Embodiment 2 in the unit movement regulating means 33*f*, 80*c*. The like reference numerals as in the foregoing embodiments are assigned to the elements having the corresponding functions, and the detailed description thereof is omitted. The structures of the left and right guiding plates 80L, 80R of this embodiment are the same as those of the guiding plates 80L, 80R of Embodiment 2. (a) and (b) of FIG. 4 are perspective views of the right-half and left-half parts of the unit 200 in the state that the cartridges 33 are dismounted. The outsides of the left side plate 31*a*-L and the right side plate 31*a*-R of the frame 31*a* are provided with symmetrical bosses (unit side engaging portions) 31*f*, and they oppose to the ribs 80*g* of the left and right guiding plates 80L, 80R. Furthermore, they are provided with the pins (image forming unit side movable members) 47 (47Y, (47M, 47C, 47K) correspondingly to the cartridges 33, respectively. As shown in (a) of FIG. 19 which is a sectional view of the pin part, the pin 47 is urged by a spring 48 so that it withdraws when the developing cartridge 33 and the projection 33*f* thereof are not in the mounting portion 31*c*. As shown in (b) of FIG. 19, by inserting the cartridge 33 into the mounting portion 31*c*, it is outwardly pushed by the projection 33*f*. FIG. 20A is a right side longitudinal sectional view of the image forming apparatus 100 in the state that the cover 10 is manually rotated to the open position, and the unit 200 is moved to the mounting and dismounting position B from transfer position A.

Figure 20A:
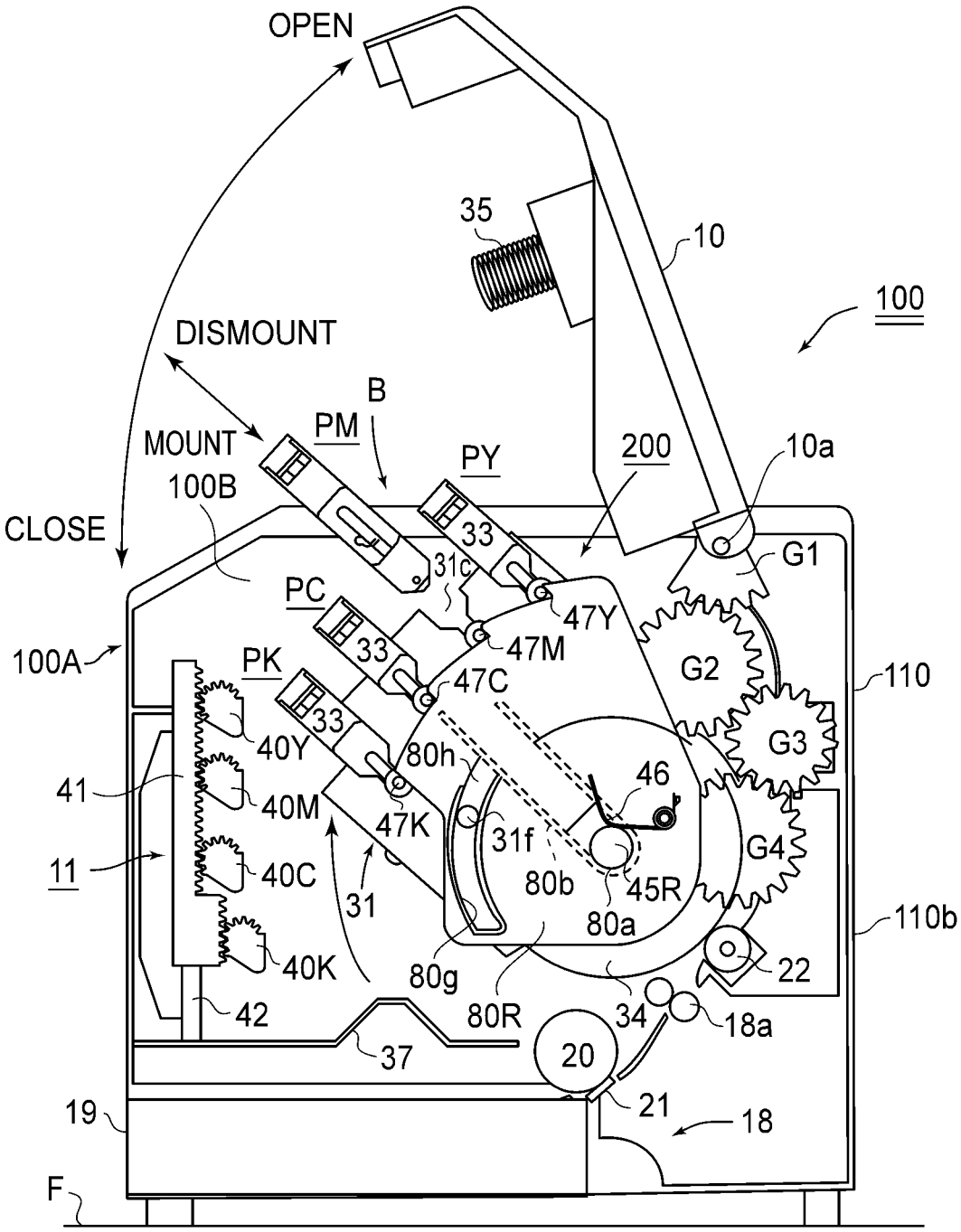
FIG. 20A illustrates the image forming apparatus, wherein the cover is opened to the open position and the image forming unit is in the mounting and dismounting position.
Figure 20B:
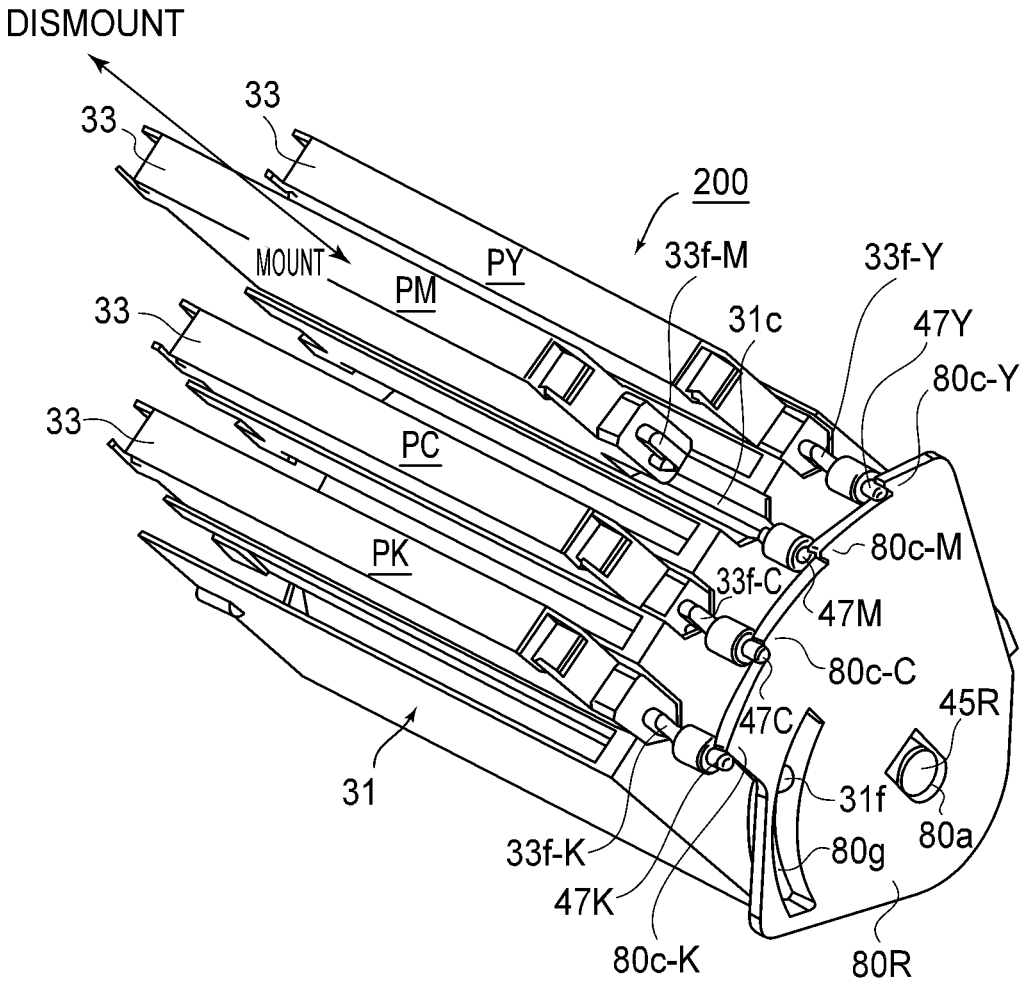
FIG. 20B is a partial enlarged perspective view of FIG. 20A.
Figure 21A:
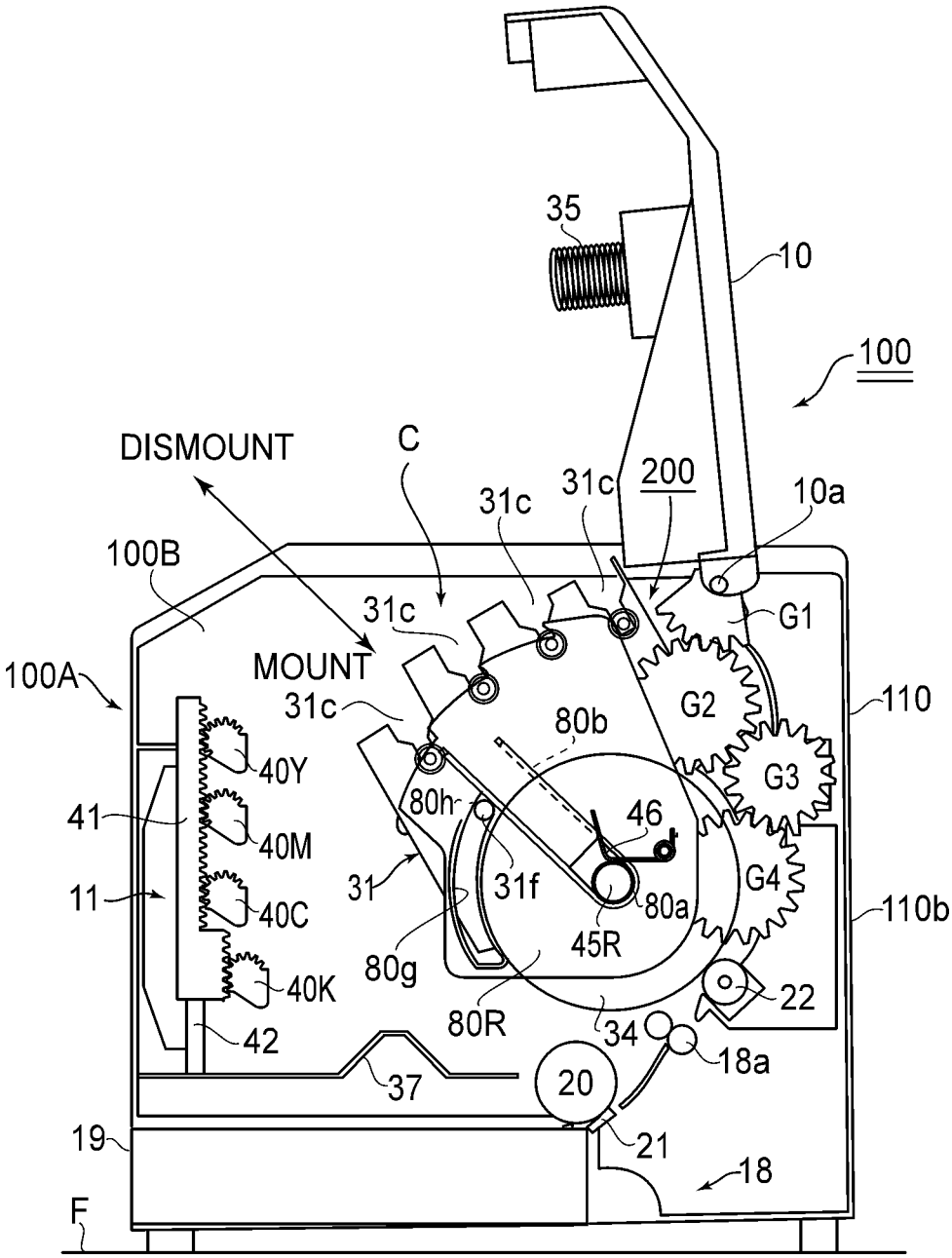
FIG. 21A illustrates the image forming apparatus in the state that the image forming unit is in the intermediary transfer member mounting and dismounting position.

FIG. 20B is a perspective view of the guiding plate 80R and the image forming unit 200. The pins 47 (47Y, 47M, 47C, 47K) abuts to the projection 80*c* (80*c*-Y, 80*c*-M, 80*c*-C, 80*c*-K) of the guiding plate 80 to prevent the further rotation of the unit 200. In other words, the further movement of the unit 200 toward the mounting and dismounting position C from the mounting and dismounting position B is regulated. At this time, the boss 31*f* is prevented by the rib 80*g* of the guiding plate 80. For this reason, the unit 200 cannot be pulled out. In other words, in the state that the unit 200 is placed in the transfer position A and the mounting and dismounting position B, the boss 31*f* and the rib 80*g* engage with each other. By this, the dismounting of the transfer member 34 from the main assembly 100A is prevented. FIG. 21A is a sectional view of the image forming apparatus 100 in the state that the frame 31 and the transfer member 34 are detachably mountable relative to the main assembly 100A. When the cartridge 33 is removed altogether, all the pins 47 (47Y, 47M, 47C, 47K) withdraw, and the engagement with the projections 80*c* (80*c*-Y, 80*c*-M, 80*c*-C, 80*c*-K) of the guiding plate 80 is released. By this, without the pin 47 being prevented by the rib 80*g*, the movements of the unit 200 (sub-frame 31 and intermediary transfer unit 34) to the mounting and dismounting position C from the mounting and dismounting position B are permitted. In other words, similarly to Embodiment 2, by pushing the spring 46 open, the unit 200 is detachably mountable relative to the main assembly 100A along the guide 80*b*.

As has been described in the foregoing, in order to prevent that the unit 200 moves to the mounting and dismounting position C from the mounting and dismounting position B, the cartridge 33 may not be used directly. As a structure for preventing, another member such as a movable pin 47 operated by the dismounting of the cartridge 33 maybe used. By this, the distortion due to applying a weight for preventing the rotation of the unit 200 directly to the cartridge 33 is avoidable. According to this embodiment, the mounting and demounting prevention member (boss 31*f*) for the frame 31 and the intermediary transfer unit 34 similar to Embodiment 2 is used, but the key configuration 45*a* and so on maybe used similarly to Embodiment 1, and another structure may be used.

The structure of the image forming apparatus 100 of the above-described Embodiment 3 is summarized as follows. The fundamental structure is the same as the image forming apparatuses 100 of Embodiments 1 and 2. The cartridge 33 is provided with the cartridge side contact member 33*f*. The unit movement regulating means is provided with the image forming unit side movable member 47 which is provided on the image forming unit 200 and which is in the engagement position in the state that it contacts to the cartridge side contact member 33*f* and is in the retracted position in the state that it does not contact to the contact member 33*f*. It is provided with the main assembly side engaging member 80*c* engaged with the movable member 47 which is provided in the main assembly 100A and which is in the engagement position. In the state that the cartridge 33 is mounted to the mounting portion 31*c*, and the engaging member 33*f* and the movable member 47 is in engagement with each other, the movement to the mounting and dismounting position C of the unit 200 is prevented.

Figure 21B:
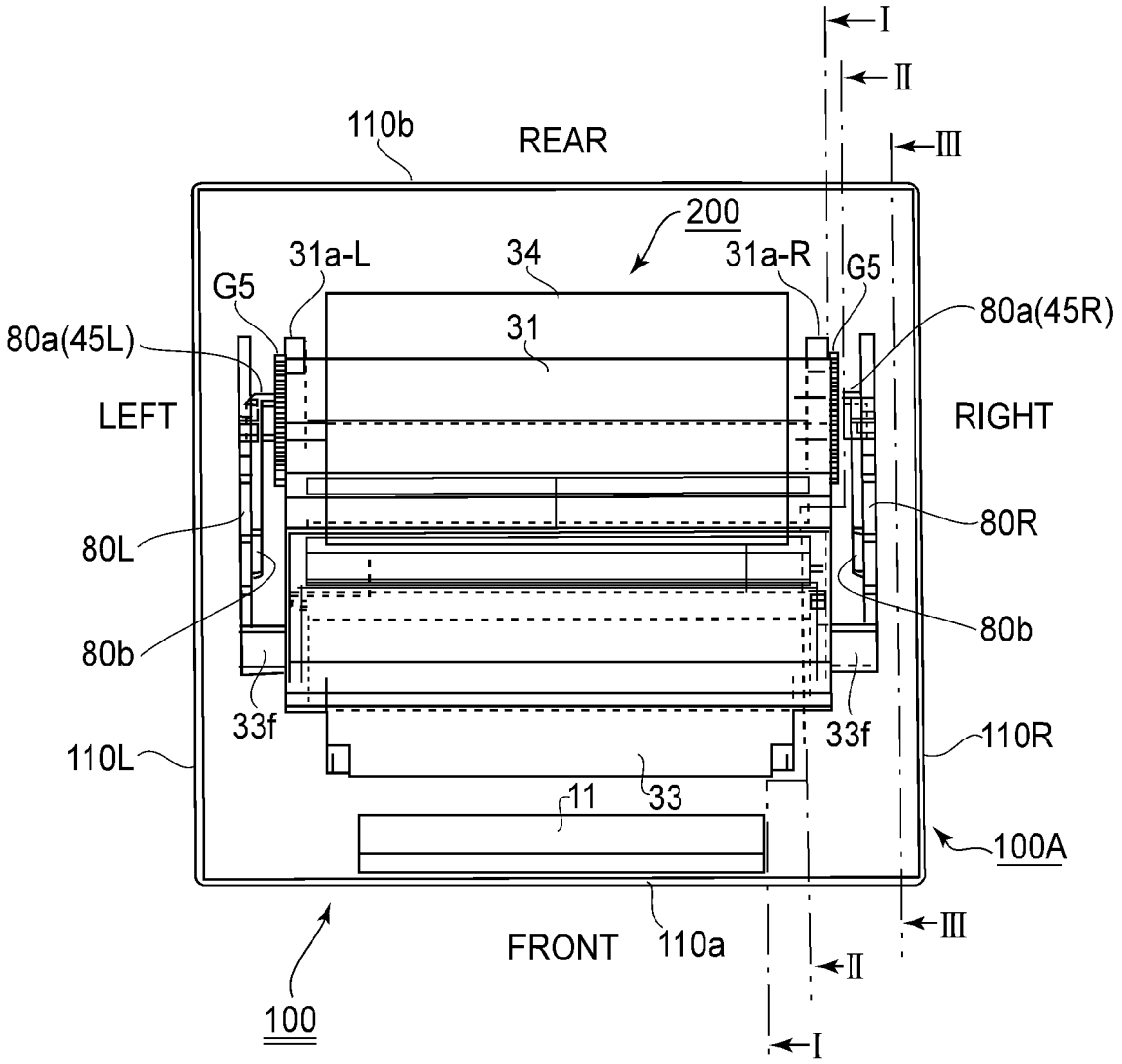
FIG. 21B is a top plan view (cross-sectional top plan view) illustrating an inside of the image forming apparatus of Embodiments 1-3.

Here, FIG. 21B is a top plan view inside the image forming apparatus described in Embodiments 1-3 (crossing top plan view). FIG. 2A is a sectional view taken along a section line I-I (phantom line) of (b) of FIG. 21. FIG. 6A, FIG. 6B, and FIG. 8A, FIG. 8B, FIG. 10A, FIG. 10B are sectional views taken along a section line II-II of (b) FIG. 21B. FIG. 12A, FIG. 13A, FIG. 13B, FIG. 16A, FIG. 17, FIG. 20A and FIG. 21A are sectional views taken along a line III-III of FIG. 21B. According to the embodiments, the mounting and dismounting operativity of the cartridge 33 and the intermediary transfer member to the main assembly 100A can be improved. Furthermore, the color electrophotographic image forming apparatus can be provided in which at the time of the replacement of the cartridge, the cartridge can be replaced without retracting the scanner unit (image exposure device) 11. According to this embodiment, the user's operations are simple and the incorrect mounting of the cartridge 33 which may be induced at the time of a maintenance and so on can be prevented. The color electrophotographic image forming apparatus can be provided in which the unit which is low in the replacement frequency is made mountable and dismountable only in necessity so that the usability is improved, and in which the apparatus is downsized.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 048100/2009 filed Mar. 2, 2009, which is hereby incorporated by reference.

What is claimed is:

1. A color electrophotographic image forming apparatus for forming a color image on a recording material, said color electrophotographic image forming apparatus comprising:

a plurality of cartridge mounting portions for dismountably mounting cartridges;

an intermediary transfer member onto which developed images formed on a plurality of electrophotographic photosensitive drums are transferred, said intermediary transfer member being provided opposed to said electrophotographic photosensitive drums;

an image forming unit comprising said cartridge mounting portions and said intermediary transfer member, said image forming unit being movable between a transfer position for transferring, onto the recording material, the developed images transferred onto said intermediary transfer member from the electrophotographic photosensitive drums, a cartridge mounting and dismounting position for mounting and dismounting said cartridges relative to said cartridge mounting portions, and an intermediary transfer member mounting and dismounting position for mounting and dismounting said intermediary transfer member relative to a main assembly of the apparatus, wherein the intermediary transfer member mounting and dismounting position is different from the cartridge mounting and dismounting position; and a unit movement preventing means for permitting said image forming unit to move to the intermediary transfer member mounting and dismounting position when no cartridge is mounted to any of said cartridge mounting portions, and for preventing said image forming unit from moving to the intermediary transfer member mounting and dismounting position when at least one of said cartridges is mounted to at least one of said cartridge mounting portions, wherein said at least one cartridge includes a cartridge side engageable member, and said unit movement preventing means is a main assembly side engageable member provided in said main assembly, and wherein said unit movement preventing means prevents said image forming unit from moving to the intermediary transfer member mounting and dismounting position in the state that said at least one cartridge is mounted to said at least one cartridge mounting portion, and said cartridge side engageable member is in engagement with said main assembly side engageable member.

2. The color electrophotographic image forming apparatus according to claim 1, further comprising:

an opening for permitting mounting and dismounting of said cartridges relative to said cartridge mounting portions of said image forming unit placed in the mounting and dismounting position;

an openable member capable of opening and closing said opening, said openable member being movable between a closing position for closing said opening and an open position for opening said opening; and an interrelating member for moving said image forming unit from the transfer position to the cartridge mounting and dismounting position in interrelation with manual movement of said openable member from the closing position to the open position and for moving said image forming unit from said cartridge mounting and dismounting position to the transfer position in interrelation with manual movement of said openable member from the open position to the closing position.

3. The color electrophotographic image forming apparatus according to claim 1, wherein said image forming unit is movable about a rotation axis of an intermediary transfer drum as said intermediary transfer member moves between the cartridge mounting and dismounting position, the transfer position, and the intermediary transfer member mounting and dismounting position.

4. The color electrophotographic image forming apparatus according to claim 1, wherein said electrophotographic photosensitive member drums are provided in said image forming unit, and said cartridges are developing cartridges including developing rollers for developing electrostatic latent images formed on said electrophotographic photosensitive member drums, and wherein said developing cartridges are mounted to said cartridge mounting portions such that said developing rollers are opposed to said electrophotographic photosensitive member drums, respectively, and when said image forming unit is placed in the transfer position, said developing rollers develop the electrostatic latent images with a gap between said developing rollers and said electrophotographic photosensitive member drums.

5. A color electrophotographic image forming apparatus for forming a color image on a recording material, said color electrophotographic image forming apparatus comprising:

a plurality of cartridge mounting portions for dismountably mounting cartridges;

an intermediary transfer member onto which developed images formed on a plurality of electrophotographic photosensitive drums are transferred, said intermediary transfer member being provided opposed to said electrophotographic photosensitive drums;

an image forming unit comprising said cartridge mounting portions and said intermediary transfer member, said image forming unit being movable between a transfer position for transferring, onto the recording material, the developed images transferred onto said intermediary transfer member from the electrophotographic photosensitive drums, a cartridge mounting and dismounting position for mounting and dismounting said cartridges relative to said cartridge mounting portions, and an intermediary transfer member mounting and dismounting position for mounting and dismounting said intermediary transfer member relative to a main assembly of the apparatus, wherein the intermediary transfer member mounting and dismounting position is different from the cartridge mounting and dismounting position; and a unit movement preventing means for permitting said image forming unit to move to the intermediary transfer member mounting and dismounting position when no cartridge is mounted to any of said cartridge mounting portions, and for preventing said image forming unit from moving to the intermediary transfer member mounting and dismounting position when at least one of said cartridges is mounted to at least one of said cartridge mounting portions, wherein said at least one cartridge includes a cartridge side contact member, wherein said unit movement preventing means includes (i) an image forming unit side movable member provided on said image forming unit and taking an engaging position when it is contacted to said cartridge side contact member and taking a retracted position when it is not contacted to said cartridge side contact member, and (ii) a main assembly side engageable member provided in said main assembly and engageable with said image forming unit side movable member taking the engaging position, and wherein said unit movement preventing means prevents said image forming unit from moving to the intermediary transfer member mounting and dismounting position in the state that said at least one cartridge is mounted to said cartridge mounting portion, and said cartridge side engageable member is engaged with said image forming unit side movable member.

6. The color electrophotographic image forming apparatus according to claim 5, further comprising:

an opening for permitting mounting and dismounting of said cartridges relative to said cartridge mounting portions of said image forming unit placed in the mounting and dismounting position;

an openable member capable of opening and closing said opening, said openable member being movable between a closing position for closing said opening and an open position for opening said opening; and an interrelating member for moving said image forming unit from the transfer position to the cartridge mounting and dismounting position in interrelation with manual movement of said openable member from the closing position to the open position and for moving said image forming unit from said cartridge mounting and dismounting position to the transfer position in interrelation with manual movement of said openable member from the open position to the closing position.

7. The color electrophotographic image forming apparatus according to claim 5, wherein said image forming unit is movable about a rotation axis of an intermediary transfer drum as said intermediary transfer member moves between the cartridge mounting and dismounting position, the transfer position, and the intermediary transfer member mounting and dismounting position.

8. The color electrophotographic image forming apparatus according to claim 5, wherein said electrophotographic photosensitive member drums are provided in said image forming unit, and said cartridges are developing cartridges including developing rollers for developing electrostatic latent images formed on said electrophotographic photosensitive member drums, and wherein said developing cartridges are mounted to said cartridge mounting portions such that said developing rollers are opposed to said electrophotographic photosensitive member drums, respectively, and when said image forming unit is placed in the transfer position, said developing rollers develop the electrostatic latent images with a gap between said developing rollers and said electrophotographic photosensitive member drums.

9. A color electrophotographic image forming apparatus for forming a color image on a recording material, said color electrophotographic image forming apparatus comprising:

a plurality of cartridge mounting portions for dismountably mounting cartridges;

an intermediary transfer member onto which developed images formed on a plurality of electrophotographic photosensitive drums are transferred, said intermediary transfer member being provided opposed to said electrophotographic photosensitive drums;

an image forming unit comprising said cartridge mounting portions and said intermediary transfer member, said image forming unit being movable between a transfer position for transferring, onto the recording material, the developed images transferred onto said intermediary transfer member from the electrophotographic photosensitive drums, a cartridge mounting and dismounting position for mounting and dismounting said cartridges relative to said cartridge mounting portions, and an intermediary transfer member mounting and dismounting position for mounting and dismounting said intermediary transfer member relative to a main assembly of the apparatus, wherein the intermediary transfer member mounting and dismounting position is different from the cartridge mounting and dismounting position; and a unit movement preventing means for permitting said image forming unit to move to the intermediary transfer member mounting and dismounting position when no cartridge is mounted to any of said cartridge mounting portions, and for preventing said image forming unit from moving to the intermediary transfer member mounting and dismounting position when at least one of said cartridges is mounted to at least one of said cartridge mounting portions, wherein said image forming unit includes a unit side engageable member, and said main assembly of the apparatus includes a main assembly side engageable member, and wherein, when said image forming unit is in the transfer position or the cartridge mounting and dismounting position, said unit side engageable member is engaged with said main assembly side engageable member to prevent said intermediary transfer member from being dismounted from said main assembly of the apparatus, and when said image forming unit is in the intermediary transfer member mounting and dismounting position, said unit side engageable member is not engaged with said main assembly side engageable member to permit said intermediary transfer member to be dismounted from said main assembly of the apparatus.

10. The color electrophotographic image forming apparatus according to claim 9, further comprising:

an opening for permitting mounting and dismounting of said cartridges relative to said cartridge mounting portions of said image forming unit placed in the mounting and dismounting position;

an openable member capable of opening and closing said opening, said openable member being movable between a closing position for closing said opening and an open position for opening said opening; and an interrelating member for moving said image forming unit from the transfer position to the cartridge mounting and dismounting position in interrelation with manual movement of said openable member from the closing position to the open position and for moving said image forming unit from said cartridge mounting and dismounting position to the transfer position in interrelation with manual movement of said openable member from the open position to the closing position.

11. The color electrophotographic image forming apparatus according to claim 9, wherein said image forming unit is movable about a rotation axis of an intermediary transfer drum as said intermediary transfer member moves between the cartridge mounting and dismounting position, the transfer position, and the intermediary transfer member mounting and dismounting position.

12. The color electrophotographic image forming apparatus according to claim 9, wherein said electrophotographic photosensitive member drums are provided in said image forming unit, and said cartridges are developing cartridges including developing rollers for developing electrostatic latent images formed on said electrophotographic photosensitive member drums, and wherein said developing cartridges are mounted to said cartridge mounting portions such that said developing rollers are opposed to said electrophotographic photosensitive member drums, respectively, and when said image forming unit is placed in the transfer position, said developing rollers develop the electrostatic latent images with a gap between said developing rollers and said electrophotographic photosensitive member drums.

* * * * *